US009713361B2

(12) United States Patent
Fisher et al.

(10) Patent No.: US 9,713,361 B2
(45) Date of Patent: Jul. 25, 2017

(54) BOTTOM-DOWN LAST FOR 3D FORMING

(71) Applicant: Nike, Inc., Beaverton, OR (US)

(72) Inventors: Sam Fisher, Portland, OR (US); Jared M. Kilmer, Vancouver, WA (US); Thomas Berend, Beaverton, OR (US); Tony H. Le, Portland, OR (US)

(73) Assignee: NIKE, Inc., Beaverton, OR (US)

( * ) Notice: Subject to any disclaimer, the term of this patent is extended or adjusted under 35 U.S.C. 154(b) by 782 days.

(21) Appl. No.: 13/773,771

(22) Filed: Feb. 22, 2013

(65) Prior Publication Data

US 2014/0237853 A1 Aug. 28, 2014

(51) Int. Cl.

| | |
|---|---|
| ***A43D 3/02*** | (2006.01) |
| ***A43D 9/00*** | (2006.01) |
| ***A43D 25/07*** | (2006.01) |
| ***A43B 23/02*** | (2006.01) |

(52) U.S. Cl.

CPC ..... *A43B 23/0245* (2013.01); *A43D 3/02* (2013.01); *A43D 3/022* (2013.01); *A43D 9/00* (2013.01); *A43D 25/07* (2013.01)

(58) Field of Classification Search

CPC ..... A43D 3/02; A43D 3/022; A43D 3/028; A43D 3/1408; A43D 5/02; A43D 23/0245; A43D 9/00; A43D 25/07; A43D 3/04; A43D 3/14; A43D 3/1416; A43B 23/0245

USPC ... 12/133 R, 133 A, 133 B, 140, 141, 129.4, 12/128 R, 133 C, 133 M, 128 C, 128 D, 12/145, 7–14.5

See application file for complete search history.

(56) References Cited

U.S. PATENT DOCUMENTS

| | | | | | |
|---|---|---|---|---|---|
| 10,679 | A | * | 3/1854 | Daugherty | A43D 3/02 12/128 F |
| 297,633 | A | * | 4/1884 | Reynolds | A43D 3/02 12/133 M |
| 653,227 | A | * | 7/1900 | Forster | A43D 5/02 12/123 |
| 715,472 | A | * | 12/1902 | French | A43D 3/022 12/113 |
| 1,444,264 | A | * | 2/1923 | O'Neill | A43D 3/1408 211/37 |
| 1,731,024 | A | | 10/1929 | Richardson | |

(Continued)

FOREIGN PATENT DOCUMENTS

| | | |
|---|---|---|
| CH | 285223 | 8/1952 |
| CH | 616 094 A5 | 3/1980 |

(Continued)

OTHER PUBLICATIONS

International Search Report and Written Opinion mailed Oct. 28, 2014 in PCT/US2014/017239.

(Continued)

*Primary Examiner* — Khoa Huynh
*Assistant Examiner* — Griffin Hall
(74) *Attorney, Agent, or Firm* — Banner & Witcoff, Ltd.

(57) ABSTRACT

A method and system for making uppers for articles of footwear is disclosed. The system comprises a last assembly as well as a pressing system for forming uppers with the last assembly. The last assembly includes a last member and a base member. The last member is inverted so that the bottom surface of the last member is oriented away from the base member.

11 Claims, 25 Drawing Sheets

(56) References Cited

U.S. PATENT DOCUMENTS

| | | | | |
|---|---|---|---|---|
| 1,825,276 | A * | 9/1931 | L'Hollier | A43B 3/20 12/133 R |
| 3,141,183 | A | 7/1964 | Ralphs | |
| 3,160,899 | A | 12/1964 | Bille et al. | |
| 3,228,049 | A | 1/1966 | Sbicca | |
| 3,362,091 | A | 1/1968 | Drago | |
| 3,512,197 | A | 5/1970 | Carr, Sr. | |
| 3,803,655 | A | 4/1974 | White et al. | |
| 3,855,657 | A | 12/1974 | Mazzotta | |
| 3,938,211 | A | 2/1976 | Armstrong | |
| 4,266,312 | A | 5/1981 | Hall | |
| 4,290,838 | A | 9/1981 | Reavill et al. | |
| 4,601,078 | A | 7/1986 | Bertolaja | |
| 4,660,242 | A | 4/1987 | Vomberger et al. | |
| 4,964,229 | A | 10/1990 | Laberge | |
| 5,108,532 | A | 4/1992 | Thein | |
| 5,129,813 | A | 7/1992 | Sheperd | |
| 5,275,775 | A | 1/1994 | Riecken | |
| 5,296,182 | A | 3/1994 | Thary | |
| 5,885,500 | A | 3/1999 | Tawney et al. | |
| 5,940,991 | A | 8/1999 | Cabalquinto | |
| 6,295,679 | B1 | 10/2001 | Chenevert | |
| 6,299,817 | B1 | 10/2001 | Parkinson | |
| 6,622,332 | B2 | 9/2003 | Furuhashi | |
| 6,670,029 | B2 | 12/2003 | Norton et al. | |
| 7,247,264 | B2 | 7/2007 | Buchler et al. | |
| 8,162,022 | B2 | 4/2012 | Hull et al. | |
| 2008/0028544 | A1 | 2/2008 | Park | |
| 2008/0053609 | A1 | 3/2008 | Renz | |
| 2008/0127426 | A1 | 6/2008 | Morlacchi et al. | |
| 2008/0141469 | A1 | 6/2008 | Park | |
| 2008/0250668 | A1 | 10/2008 | Marvin et al. | |
| 2010/0051195 | A1 | 3/2010 | Damm | |
| 2010/0115792 | A1 | 5/2010 | Muller et al. | |
| 2010/0139853 | A1 | 6/2010 | Park | |
| 2010/0275393 | A1 | 11/2010 | Jou et al. | |
| 2011/0088282 | A1 | 4/2011 | Dojan et al. | |
| 2012/0084999 | A1 | 4/2012 | Davis et al. | |
| 2012/0102782 | A1 | 5/2012 | Swigart et al. | |
| 2014/0223671 | A1 | 8/2014 | Fisher et al. | |
| 2014/0237738 | A1 | 8/2014 | Johnson et al. | |
| 2014/0239556 | A1 | 8/2014 | Fisher et al. | |

FOREIGN PATENT DOCUMENTS

| | | | | |
|---|---|---|---|---|
| DE | 3421372 | A1 * | 12/1985 | A43D 3/1408 |
| EP | 0042136 | A1 | 12/1981 | |
| EP | 0222964 | A1 | 5/1987 | |
| EP | 0 264 898 | A2 | 4/1988 | |
| EP | 0264896 | | 4/1988 | |
| EP | 586360 | | 3/1994 | |
| FR | 2525877 | A1 | 11/1983 | |
| FR | 2 562 770 | A1 | 10/1985 | |
| FR | 2895648 | A1 | 7/2007 | |
| GB | 443696 | | 3/1936 | |
| GB | 494885 | | 11/1938 | |
| JP | H0516048 | A | 1/1993 | |
| JP | 05057786 | | 3/1993 | |
| JP | 9207149 | | 8/1997 | |
| JP | H09322810 | A | 12/1997 | |
| JP | 2004105323 | | 4/2004 | |
| KR | 200308065 | Y1 | 3/2003 | |
| NL | 7714472 | A | 7/1979 | |
| SU | 1639603 | A1 | 4/1991 | |
| WO | 9003744 | | 4/1990 | |
| WO | 0018267 | A1 | 4/2000 | |
| WO | 02/11571 | A1 | 2/2002 | |
| WO | 02067712 | A1 | 9/2002 | |
| WO | 2004/112525 | A1 | 12/2004 | |
| WO | 2011082275 | | 7/2011 | |

OTHER PUBLICATIONS

International Preliminary Report on Patentability and Written Opinion for Application No. PCT/US2014/015921, mailed Aug. 18, 2015.

International Search Report and Written Opinion for Application No. PCT/US2014/015921, mailed on Sep. 16, 2014.

International Search Report and Written Opinion for Application No. PCT/US2014/017242, mailed on Jun. 2, 2014.

International Search Report and Written Opinion for Application No. PCT/US2014/017240, mailed on Sep. 8, 2014.

Office Action mailed Jun. 11, 2015 in U.S. Appl. No. 13/773,744.

Notice of Allowance mailed Sep. 23, 2015 in U.S. Appl. No. 13/773,744.

International Preliminary Report on Patentability and Written Opinion of the International Searching Authority issued Sep. 3, 2015 in International Patent Application No. PCT/US2014/017242.

Office Action mailed Mar. 26, 2015 in U.S. Appl. No. 13/773,729.

Final Office Action mailed Sep. 1, 2015 in U.S. Appl. No. 13/773,729.

International Preliminary Report on Patentability and Written Opinion of the International Searching Authority issued Sep. 3, 2015 in International Patent Application No. PCT/US2014/017240.

International Preliminary Report on Patentability and Written Opinion of the International Searching Authority issued Sep. 3, 2015 in International Patent Application No. PCT/US2014/017239.

* cited by examiner

BOTTOM-DOWN LAST FOR 3D FORMING

BACKGROUND

The present embodiments relate generally to footwear and in particular to a method for making footwear and an associated system.

Articles of footwear generally include two primary elements: an upper and a sole structure. The upper is often formed from a plurality of material elements (e.g., textiles, polymer sheet layers, foam layers, leather, synthetic leather) that are stitched or adhesively bonded together to form a void on the interior of the footwear for comfortably and securely receiving a foot. More particularly, the upper forms a structure that extends over instep and toe areas of the foot, along medial and lateral sides of the foot, and around a heel area of the foot. The upper may also incorporate a lacing system to adjust the fit of the footwear, as well as permitting entry and removal of the foot from the void within the upper. In addition, the upper may include a tongue that extends under the lacing system to enhance adjustability and comfort of the footwear, and the upper may incorporate a heel counter.

The sole structure is secured to a lower portion of the upper so as to be positioned between the foot and the ground. In athletic footwear, for example, the sole structure may include a midsole and an outsole. The midsole may be formed from a polymer foam material that attenuates ground reaction forces (i.e., provides cushioning) during walking, running, and other ambulatory activities. The midsole may also include fluid-filled chambers, plates, moderators, or other elements that further attenuate forces, enhance stability, or influence the motions of the foot, for example. The outsole forms a ground-contacting element of the footwear and is usually fashioned from a durable and wear-resistant rubber material that includes texturing to impart traction. The sole structure may also include a sockliner positioned within the upper and proximal a lower surface of the foot to enhance footwear comfort.

SUMMARY

In one aspect, an upper for an article of footwear includes a first side portion, a second side portion and a bottom portion, where the first side portion and the second side portion are integral with the bottom portion. The upper may be formed by: placing a section of material on a last member such that a first side surface of the last member is disposed adjacent to a first portion of the section of material, such that a second side surface of the last member is disposed adjacent to a second portion of the section of material and such that a bottom surface of the last member is disposed adjacent to a third portion of the section of material, where the bottom surface of the last member corresponds to the bottom of a foot; pressing a flexible membrane against the section of material and the last member until the section of material conforms to the approximate shape of the last member and forming the upper so that the first portion of the section of material becomes the first side portion of the upper, the second portion of the section of material becomes the second side portion of the upper and the third portion of the section of material becomes the bottom portion of the upper.

A method of making an upper for an article of footwear includes placing an inner member on a last member. The method further includes associating a first side portion of a section of material with a first side surface of a last member such that the first side portion and the first side surface are disposed on opposing sides of the inner member. The method further includes associating a second side portion of the section of material with a second side surface of a last member such that the second side portion and the second side surface are disposed on opposing sides of the inner member. The method further includes associating a bottom portion of the section of material with a bottom surface of the last member such that the bottom portion and the bottom surface are disposed on opposing sides of the inner member, where the bottom surface of the last member corresponds to the bottom surface of a foot. The method further includes pressing a flexible membrane against the last member and the section of material and forming the upper, where the upper has a first side portion, a second side portion and a bottom portion and where the bottom portion extends substantially continuously between the first side portion and the second side portion.

In another aspect, a last assembly includes a last member having the approximate shape of a foot, where the last member further includes a bottom surface corresponding to a foot sole. The last assembly also includes a base member configured to receive a portion of the last member and hold the last member in a substantially fixed position. The last member is mounted to the base member such that the bottom surface of the last member is oriented away from the base member.

In another aspect, a method of making an upper for an article of footwear includes placing an inner member on a last member, the inner member including a bottom portion. The method also includes placing a section of material over the inner member such that a portion of the section of material covers the bottom portion of the inner member and pressing a flexible membrane against the last member, the inner member and the section of material such that the section of material is joined with the inner member, thereby forming the upper.

Other systems, methods, features and advantages of the embodiments will be, or will become, apparent to one of ordinary skill in the art upon examination of the following figures and detailed description. It is intended that all such additional systems, methods, features and advantages be included within this description and this summary, be within the scope of the embodiments, and be protected by the following claims.

BRIEF DESCRIPTION OF THE DRAWINGS

The embodiments can be better understood with reference to the following drawings and description. The components in the figures are not necessarily to scale, emphasis instead being placed upon illustrating the principles of the embodiments. Moreover, in the figures, like reference numerals designate corresponding parts throughout the different views.

DETAILED DESCRIPTION

Figure 1:
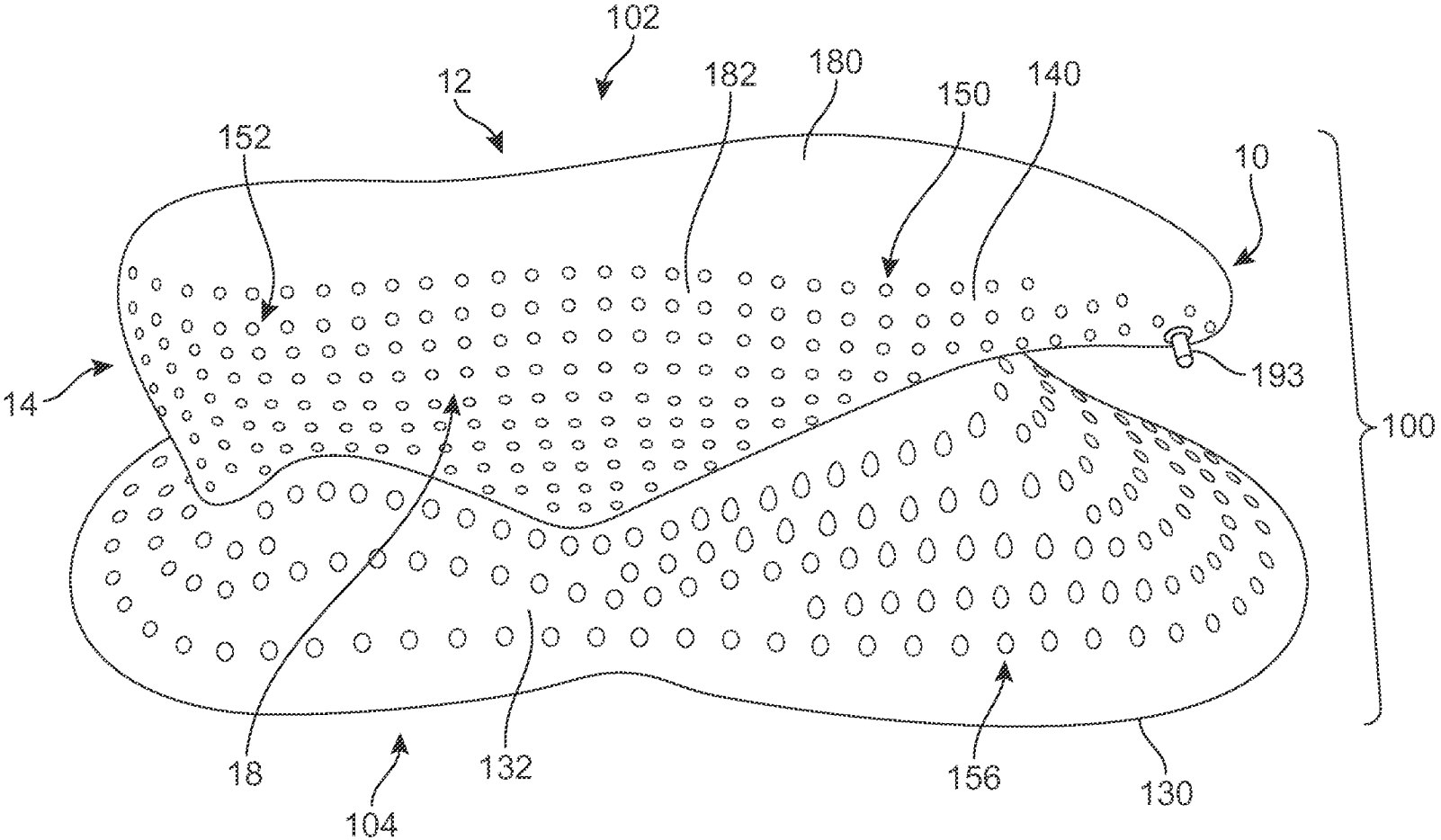
FIG. 1 is a schematic side view of an embodiment of a last assembly.
Figure 2:
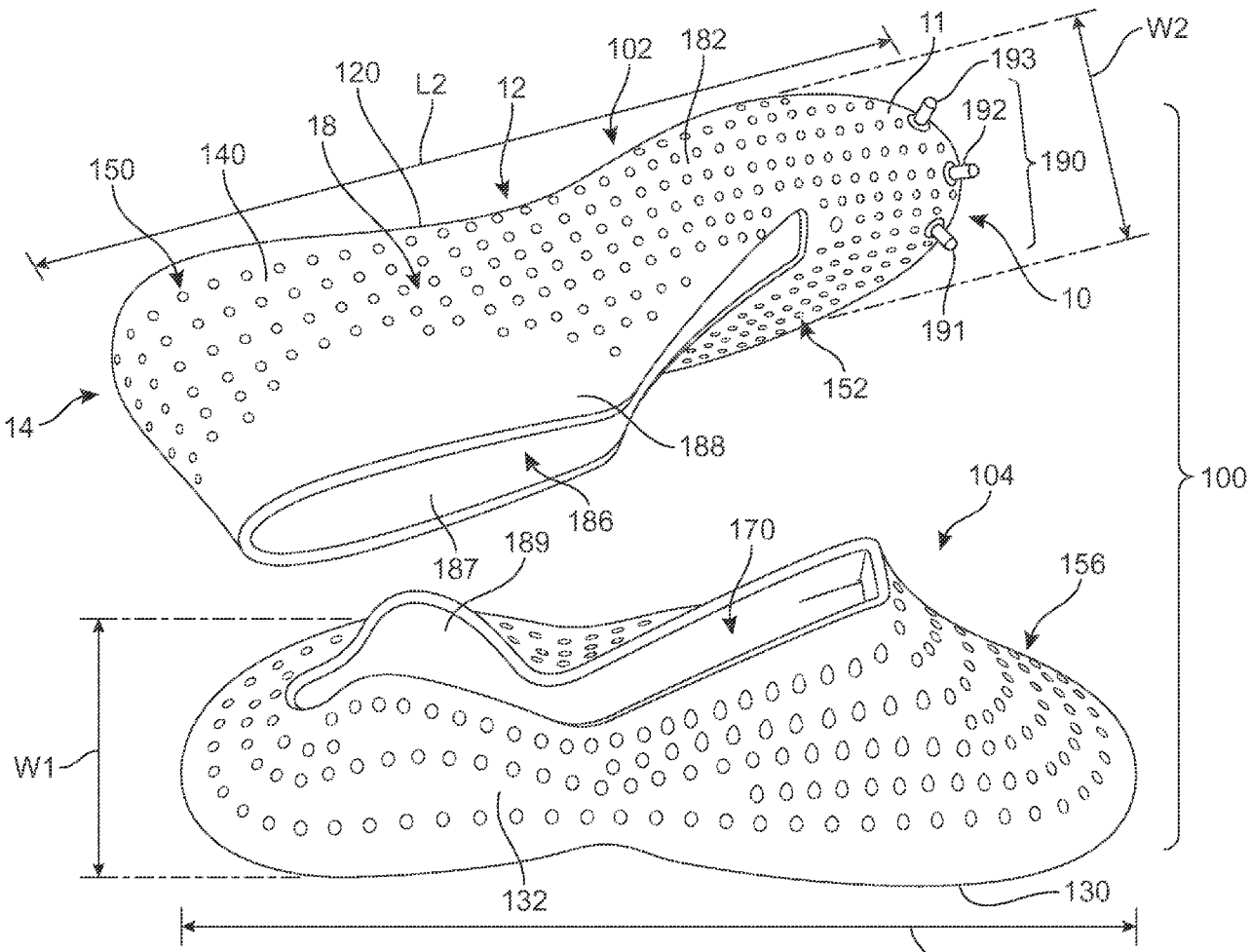
FIG. 2 is a schematic isometric view of an embodiment of a last assembly, in which a last member is separated from a base member.
Figure 3:
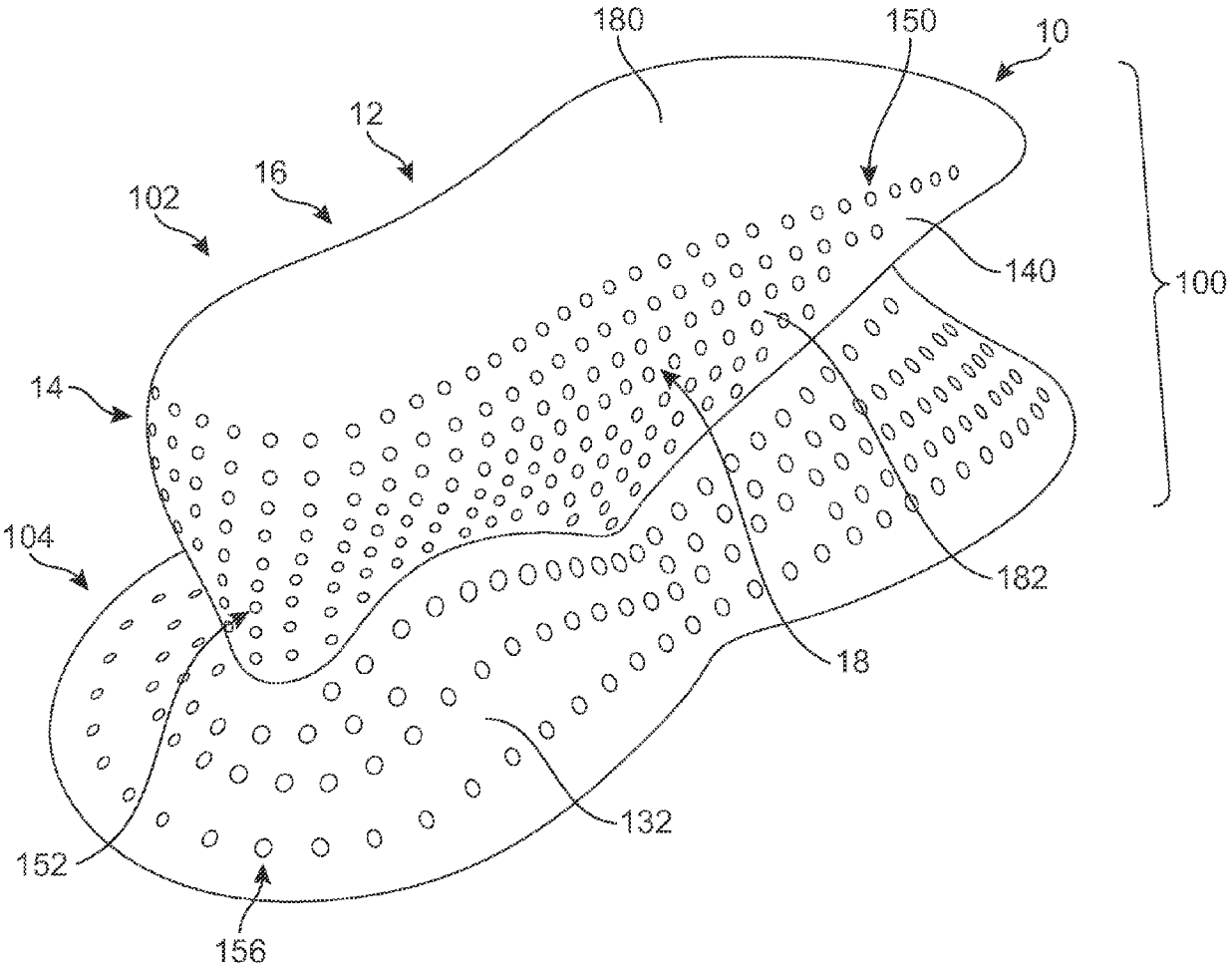
FIG. 3 is a schematic isometric rear view of an embodiment of a last assembly.

FIGS. 1 through 3 illustrate schematic isometric views of an embodiment of last assembly 100. Last assembly 100 may be configured for use with various kinds of footwear including, but not limited to: hiking boots, soccer shoes, football shoes, sneakers, running shoes, cross-training shoes, rugby shoes, basketball shoes, baseball shoes as well as other kinds of shoes. Moreover, in some embodiments last assembly 100 may be configured for use with various kinds of non-sports related footwear, including, but not limited to: slippers, sandals, high heeled footwear, loafers as well as any other kinds of footwear or apparel.

Referring to FIGS. 1 through 3, last assembly 100 may comprise various components or members. In some embodiments, last assembly 100 can include last member 102 and base member 104. Last member 102 may have the approximate geometry of a footwear last, and may generally be configured to receive materials associated with the upper of an article of footwear. Base member 104 may extend away from last member 102 and may generally provide support for last assembly 100.

Referring to FIGS. 1 and 2, for purposes of reference, last member 102 may be divided into forefoot portion 10, midfoot portion 12 and heel portion 14. Forefoot portion 10 may be generally associated with the toes and joints connecting the metatarsals with the phalanges. Midfoot portion 12 may be generally associated with the arch of a foot. Likewise, heel portion 14 may be generally associated with the heel of a foot, including the calcaneus bone. In addition, last member 102 may include lateral side 16 and medial side 18. In particular, lateral side 16 and medial side 18 may be opposing sides of last member 102. Furthermore, both lateral side 16 and medial side 18 may extend through forefoot portion 10, midfoot portion 12 and heel portion 14.

It will be understood that forefoot portion 10, midfoot portion 12 and heel portion 14 are only intended for purposes of description and are not intended to demarcate precise regions of last assembly 102. Likewise, lateral side 16 and medial side 18 are intended to represent generally two sides of a component, rather than precisely demarcating last member 102 into two halves.

For consistency and convenience, directional adjectives are employed throughout this detailed description corresponding to the illustrated embodiments. The term "longitudinal" as used throughout this detailed description and in the claims refers to a direction extending a length of a component. In some cases, the longitudinal direction may extend from a forefoot portion to a heel portion of the last member. Also, the term "lateral" as used throughout this detailed description and in the claims refers to a direction extending a width of a component, such as a last member. For example, the lateral direction may extend between a medial side and a lateral side of a last member. Furthermore, the term "vertical" as used throughout this detailed description and in the claims refers to a direction that is perpendicular to both the longitudinal and lateral directions. In situations where a last assembly is placed on a ground surface, the upwards vertical direction may be oriented away from the ground surface, while the downwards vertical direction may be oriented towards the ground surface. It will be understood that each of these directional adjectives may be also be applied to base member 104 as well.

Figure 8:
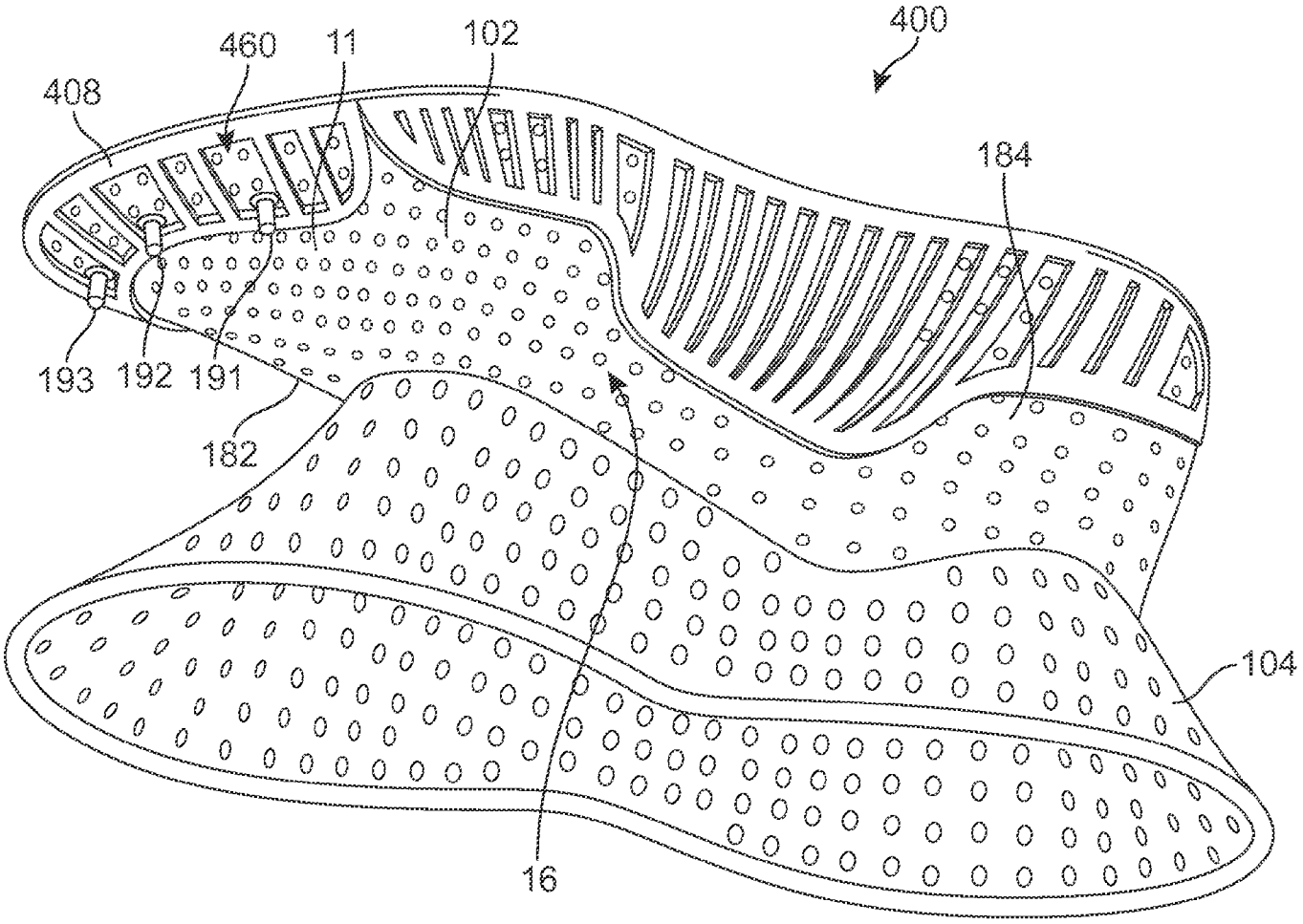
FIG. 8 is a front isometric view of a portion of an embodiment of a section of material placed onto a last assembly, in which some portions of the section of material are temporarily fixed in place on the last assembly.

Last member 102 may comprise various surfaces, including a bottom surface 180, a first side surface 182 and a second side surface 184 (see FIG. 8). Each of bottom surface 180, first side surface 182 and second side surface 184 may generally extend from forefoot portion 10 to heel portion 14. Moreover, bottom surface 180 may generally be associated with the bottom or sole of a foot, while first side surface 182 and second side surface 184 may generally be associated with the medial side and lateral side of the foot, respectively.

In different embodiments, the geometry of base member 104 may vary. In some embodiments, base member 104 has a flange-like geometry that narrows inwardly from outer peripheral edge 130. In the current embodiment, the longest portion of base member 104 has length L1, while the longest portion of last member 102 has length L2. As seen in FIG. 2, length L1 is substantially greater than length L2. Likewise, the widest portion of base member 104 has width W1, while the widest portion of last member 102 has width W2. As seen in FIG. 2, width W1 is substantially greater than width W2. Because the longest and widest portions of base member 104 are associated with outer peripheral edge 130, base member 104 provides a longer and wider base for last assembly 100 relative to last member 102, which may improve stability.

Embodiments of a last assembly may include provisions for ensuring pressure applied from an external system or apparatus (such as a pressing system described below) is adequately transmitted over a bottom surface of the last member. In some embodiments, a last member may be inverted with respect to a base member. In some cases, the last member may mounted to the base member so that a bottom surface of the last member faces away from the base member.

As seen in FIGS. 1 through 3, last member 102 and base member 104 may be arranged so that a top portion 188 of last member 102 is associated with base member 104. With this generally inverted arrangement, bottom surface 180 of last member 102 may be oriented away, or face away, from base member 104. In particular, when base member 104 is disposed on a surface such as a table, bottom surface 180 may be generally oriented in a vertically upwards direction.

In some embodiments, last member 102 and base member 104 may be seperably attached together. In some embodiments, last member 102 may further include an upper opening portion 186 that corresponds approximately with the foot receiving opening of an upper. In some embodiments, upper opening portion 186 extends along a top portion 188 of last member 102 from heel portion 14, through midfoot portion 12 and partially into forefoot portion 10. In some cases, upper opening portion 186 may provide access to an interior hollow cavity 187 that extends throughout last member 102.

Base member 104 may include receiving slot 170, which is configured to engage and receive last member 102 at upper opening portion 186. As seen in FIG. 2, both last member 102 and base member 104 may generally narrow towards upper opening portion 186 and receiving slot 170, respectively, so that base member 104 and last member 102 are connected along their substantially narrowest portions.

In some embodiments, base member 104 may be generally tapered from the region adjacent to upper opening portion 186 of last member 102 to outer peripheral edge 130 of base member 104. In other words, the outer surface 132 of base member 104 may be sloped towards outer peripheral edge 130. In some cases, outer surface 132 could have a convex geometry. In other cases, outer surface 132 could have a concave geometry. In still other cases, outer surface 132 may be an inclined surface that is approximately flat. Moreover, in still other cases, the curvature of outer surface 132 could vary over different regions. The geometry and more specifically the curvature of outer surface 132 can be varied according to considerations including, for example, desired stability or to enhance engagement with external components, such as the flexible membrane described in detail below.

With the arrangement described above, it can be appreciated that in some cases the width of last assembly 100, with last member 102 assembled with base member 104, may generally decrease from outer peripheral edge 130 of base member 104 to receiving slot 170, and then may generally increase again from top portion 188 towards bottom surface 180 of last member 102. This arrangement may be in contrast to other embodiments where a last member is arranged with the bottom surface facing downwards, or towards a base member. In such embodiments, the width of the corresponding last assembly may decrease from the bottom edge of the base member, increase quickly along the bottom part of the last member, and finally decrease again towards the top portion of the last member.

Although the embodiments described above include a separable last member and base member, in other embodiments, last member 102 and base member 104 could be permanently joined. In such embodiments, last member 102 and base member 104 could be integrally formed, for example, during a molding process. In other embodiments, last member 102 and base member 104 could be permanently joined using an adhesive or other permanent means of fastening last member 102 and base member 104.

Last assembly 100 may include provisions for temporarily holding portions of an article of footwear in place on last member 102. In some embodiments, last assembly 100 may provide a single system for temporarily holding portions of an article in place on last member 102. In other embodiments, last assembly 100 may provide two or more systems for temporarily holding portions of an article in place on last member 102. In one embodiment, for example, last assembly 100 may incorporate two types of provisions that work cooperatively to retain portions of an article on last member 102. This may help in retaining various portions of footwear on last member 102 over a wide range of different operating conditions or stages in a manufacturing process.

Some examples of provisions for retaining portions of an article and/or material on a last assembly are disclosed in Fisher, U.S. Patent Application Publication No. 2014/0223671, now U.S. patent application Ser. No. 13/767,011, filed Feb. 14, 2013 and titled "Last with Retractable Pins", the entirety of which is hereby incorporated by reference. Such examples include vacuum holes, retractable pins, adhesives as well as other provisions.

Last assembly 100 may include provisions for supplying vacuum pressure along one or more portions. In some embodiments, last assembly 100 may be provided with plurality of vacuum holes 150. In particular, in some cases, plurality of vacuum holes 150 may be incorporated into outer surface 132 of base member 104 and/or outer surface 140 of last member 102. Each vacuum hole of plurality of vacuum holes 150 may be in fluid communication with a vacuum pump or other source of a vacuum (not shown). Moreover, it should be understood that various means of providing fluid communication between vacuum holes 150 and a vacuum pump or other source could be provided in various embodiments. For example, some embodiments could incorporate internal channels, fluid lines or other means for connecting one or more vacuum holes 150 with a vacuum pump. In some embodiments, some or all of plurality of vacuum holes 150 may be in fluid communication with one or more common vacuum supply channels. In one embodiment, it is contemplated that a single vacuum supply line is introduced at a portion of last assembly 100. This single supply line is then attached in a manner that places it in fluid communication with plurality of vacuum holes 150. However, in some other embodiments a vacuum may not be supplied at a single location, but may be provided at one or more regions of last assembly 100. In another embodiment, for example, vacuum holes 150 may be in fluid communication with holes or openings on a lower surface of last assembly 100. Thus, regions of low air pressure provided beneath or along the bottom of last assembly 100 may facilitate the pulling of air through vacuum holes 150 and out through lower surface of last assembly 100.

Figure 10:
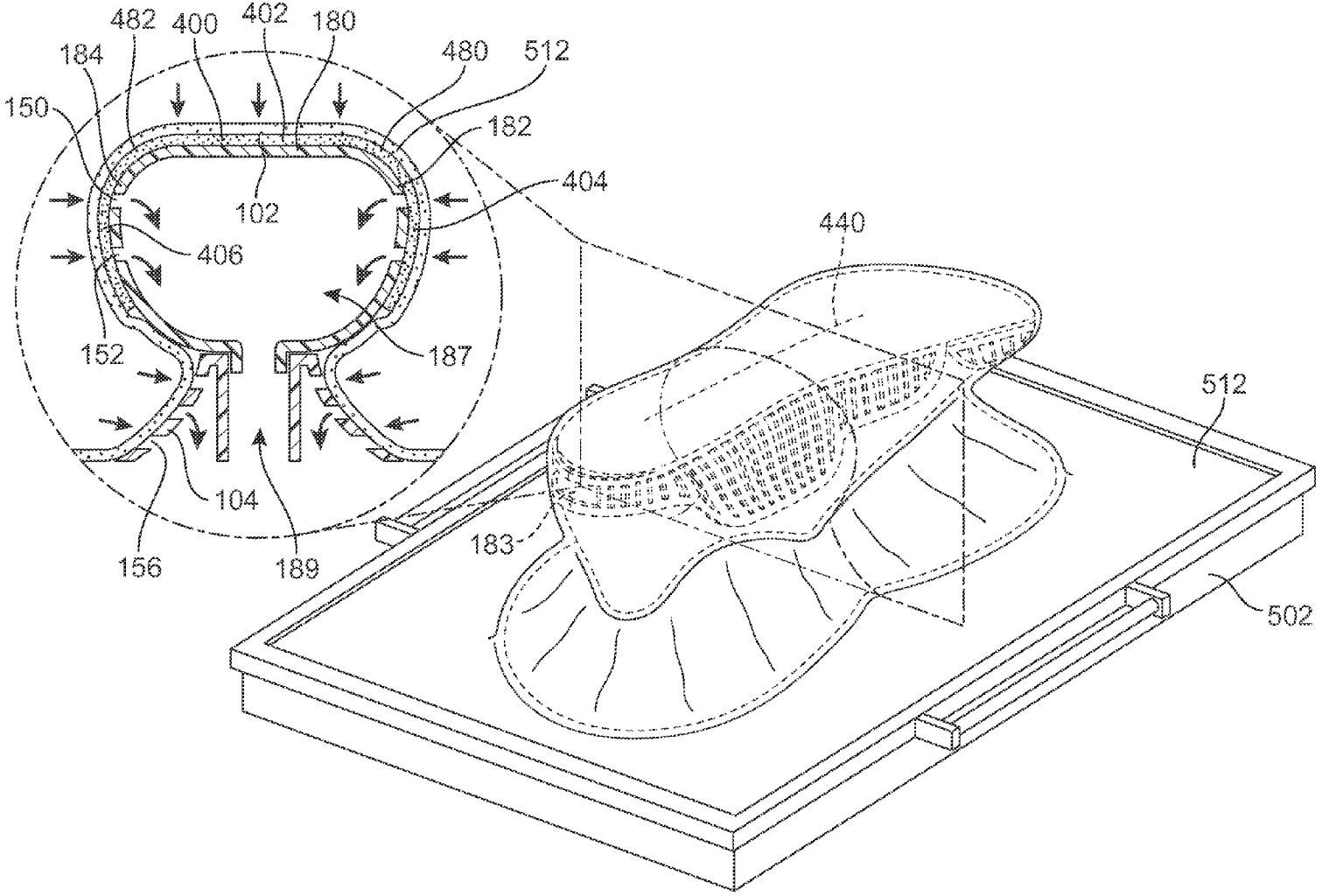
FIG. 10 is a schematic view of an embodiment of the pressing assembly of FIG. 9, in which pressure is applied by a flexible membrane to the last assembly.

In one embodiment, it is contemplated that vacuum holes 150 are in fluid communication with an interior hollow cavity 187 of last member 102 and a central hollow cavity 189 of base member 104 (see FIG. 10). As central hollow cavity 189 may be open along a bottom portion of base member 104, a vacuum pressure applied within the region of last assembly 100 may act to pull air through plurality of vacuum holes 150 and into interior hollow cavity 187 and/or central hollow cavity 189, as clearly seen in FIG. 10.

In different embodiments, the locations of plurality of vacuum holes 150 could vary. In some embodiments, vacuum holes could be incorporated into last member 102. In other embodiments, vacuum holes could be incorporated into base member 104. In one embodiment, vacuum holes could be incorporated into both last member 102 and base member 104. In some embodiments, plurality of vacuum holes 150 may include first set of vacuum holes 152 and second set of vacuum holes 156.

In the embodiment shown in FIGS. 1-3, first set of vacuum holes 152 may comprise vacuum holes located along lateral side 16 and medial side 18, respectively, of last member 102. Moreover, in some embodiments, first set of vacuum holes 152 may extend through heel portion 14 as well as midfoot portion 12 and forefoot portion 10. Additionally, second set of vacuum holes 156 may extend through a substantial entirety of base member 104. As described in further detail below, this arrangement may help provide a force necessary to temporarily hold the side portions of an upper in place as well as securing a flexible membrane around the entirety of base member 104.

It will be understood that other embodiments could include vacuum holes in any other portions of last member 102 or base member 104 and could likewise exclude vacuum holes in any portions of last member 102 and/or base member 104. Furthermore, while the current embodiment illustrates a substantially uniform arrangement and spacing for vacuum holes within first set of vacuum holes 152 and second set of vacuum holes 156, other embodiments could incorporate any other arrangements of vacuum holes. For example, in other embodiments the number, size and pattern of vacuum holes could vary. The locations and arrangements could be selected according to various considerations including, but not limited to: required magnitude of forces, curvature of components, intended use for last assembly 100 as well as possibly other considerations.

Last assembly 100 may further include additional provisions for holding one or more portions of an article (or materials used to construct an article) in place. In some embodiments, last assembly 100 may be configured with one or more retaining features for engaging one or more portions of an article. In one embodiment, last member 102 may include plurality of retractable pins that may engage one or more holes in a section of material. The term "retractable pin" as used throughout this detailed description and in the claims refers to a member or element that projects outwardly from a surface of last member 102. In one embodiment, each retractable pin comprises a pin-like projection that is configured to retract into and extend out of a cavity of last member 102, as discussed in further detail below.

The term retractable pin is not intended to be limiting and may refer to components of varying sizes, geometries and constructions. For example, while the current embodiments illustrate retractable pins as generally cylindrical in shape with rounded tips, other embodiments of retractable pins could have any other geometries. As one example, other embodiments may utilize one or more curved projections or pins, including, in some cases, a rounded hook-like end for catching onto a material.

In some embodiments, last member 102 may be configured with one or more sets of retractable pins. Last member 102 may include first set of retractable pins 190, which further includes first retractable pin 191, second retractable pin 192 and third retractable pin 193. First set of retractable pins 190 may be disposed at toe portion 11 of forefoot portion 10 (see FIG. 8). In some cases, first set of retractable pins 190 may be used to temporarily attach and fix in place segments of material intended to form toe portions of an upper.

Although the current embodiment depicts a set of retractable pins at the toe portion 11 of last member 102, in other embodiments, the configurations, number and locations of various retractable pins could vary. In some cases, the locations of each set of retractable pins may be selected to most effectively hold one or more portions of an article on last member 102. Moreover, one or more retractable pins may be optional and some embodiments may not include any retractable pins.

In addition to holding portions of material in place using various kinds of pressures (from vacuum holes and/or external pressures) and retractable pins, other embodiments could incorporate still other methods for temporarily holding portions of material to a last member. For example, in some cases, one or more adhesives could be used to temporarily hold portions of material to a last member. In other embodiments, any other means known in the art for temporarily associating portions of material with a last could be used including any kinds of fasteners such as clips, clamps, as well as possibly others fasteners.

Figure 4:
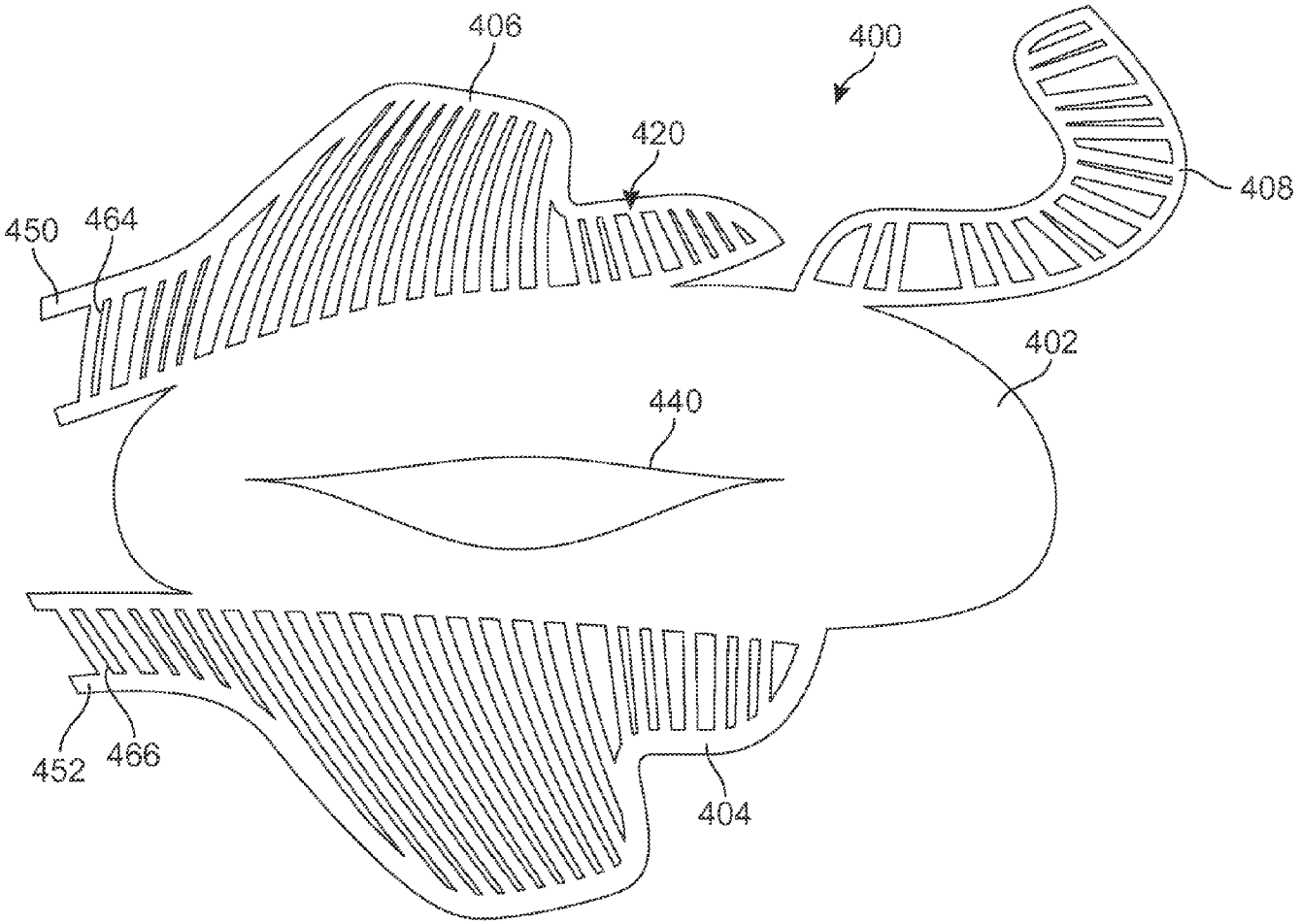
FIG. 4 is a schematic plan view of an embodiment of a section of material for use in making an article of footwear.

FIG. 4 is a bottom view of an embodiment of a section of material 400 that may be used in forming an upper. Referring to FIG. 4, section of material 400 may comprise an approximately two-dimensional section or layer. The term "two-dimensional section" as used throughout this detailed description and in the claims refers to any section where the length and width of the section are substantially greater than the thickness of the section. In some embodiments, section of material 400 may be an approximately flat section, while in other embodiments, section of material 400 may be a contoured section with various regions of curvature.

Although the current embodiments illustrate a generally homogenous single layer of material, the term "section of material" is not limited to single layers of material or generally homogenous sections. In other cases, for example, a section of material could comprise different portions having substantially different material properties. In still other cases, a section of material could comprise multiple layers, including, for example, a base layer and a trim layer as well as possible other layers. Moreover, in other embodiments multiple distinct sections of material can be associated together and formed into an upper using the methods described in this detailed description.

In some embodiments, a section of material may be pre-cut or otherwise manufactured in a pattern for making an upper. In some cases, different portions of a section of material can be configured to associate with different surfaces of a last member. For example, a section of material may include a first portion, a second portion and a third portion configured to confront a first side surface, a second side surface and a bottom surface, respectively, of a last member. The method of associating of different portions of a section of material with different surfaces of a last member during the forming process is discussed in detail below.

Section of material 400 may be pre-cut or otherwise formed into a pattern for an upper. In some embodiments, section of material 400 may include a bottom portion 402, a first side portion 404 and a second side portion 406. In some cases, section of material 400 may also include a distinct toe portion 408. The various portions may be configured to form corresponding portions of an upper. In some embodiments, for example, bottom portion 402, first side portion 404, second side portion 406 and toe portion 408 may be associated with the bottom portion, first side portion, second side portion and toe portion, respectively, of a three-dimensional formed upper, as discussed in further detail below.

The geometry of section of material 400, including the various different portions, may vary in different embodiments according to the intended design for the finished upper. In one embodiment, first side portion 404, second side portion 406 and toe portion 408 may all be configured with a plurality of slots 420, which may give the formed upper a unique aesthetic design and may also improve airflow and/or reduce weight. However, the specific design shown here for section of material 400 is only intended to be exemplary and in other embodiments any other design is possible, including any patterns or designs known for making uppers.

In some embodiments, bottom portion 402 may include provisions to facilitate three-dimensional contouring of a formed upper. In some cases, bottom portion 402 may include a central slit 440 that may improve the ability of bottom portion 402 to adapt to contours on a last member during manufacturing. In particular, central slit 440 may improve stretching as well as possibly shearing or other deformations of bottom portion 402 that may occur during formation of the upper.

In some embodiments, first side portion 404 and second side portion 406 can comprise portions that correspond with rearward portions of a formed upper. For example, in one embodiment, first side portion 404 and second side portion 406 may include first rearwardly extending portion 450 and second rearwardly extending portion 452, respectively. As discussed in further detail below, first rearwardly extending portion 450 and second rearwardly extending portion 452 may be joined together during a forming process in order to join first side portion 404 and second side portion 406 at a heel portion of an upper and thereby form a rearward portion for the upper.

Figure 5:
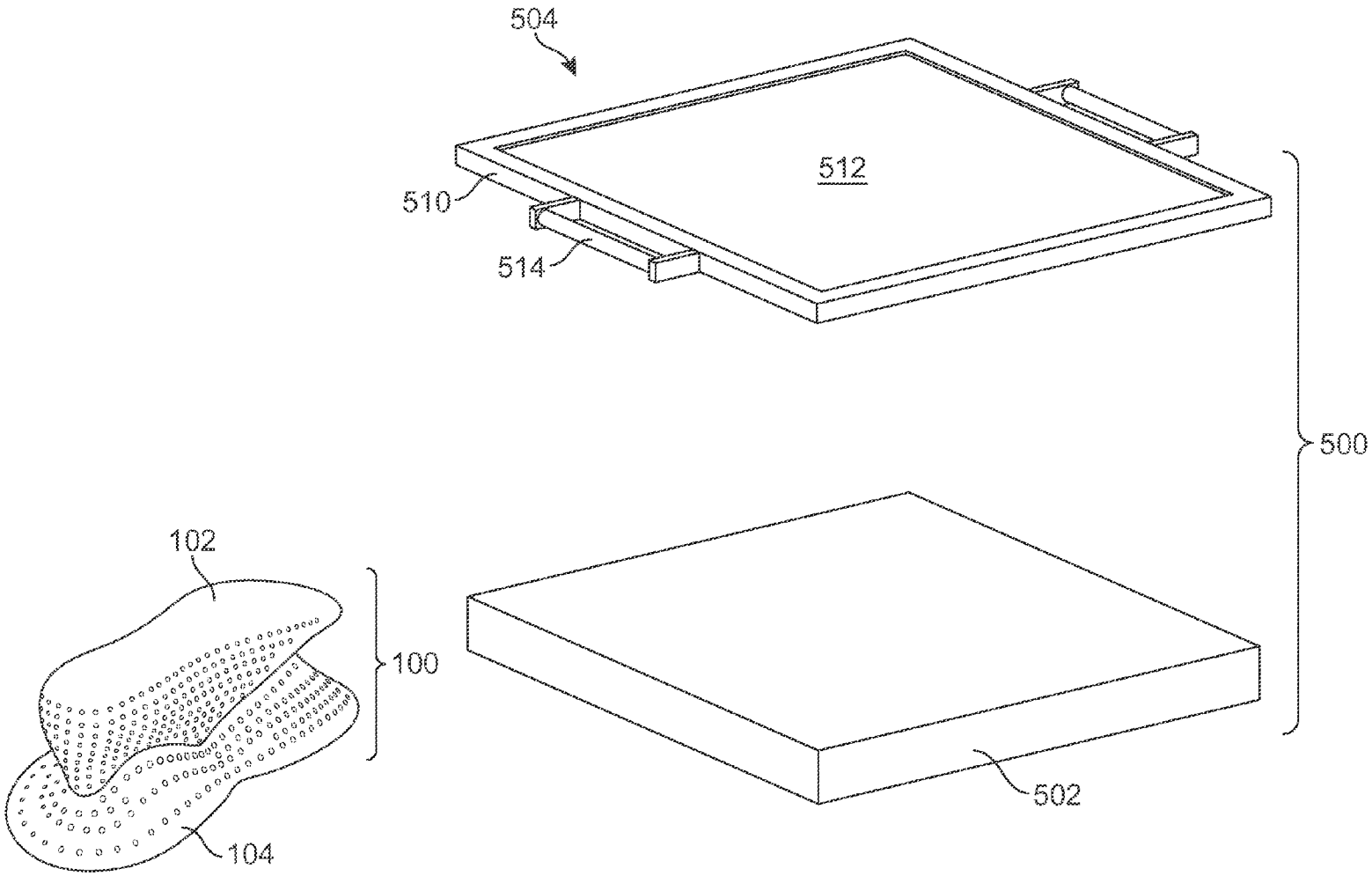
FIG. 5 is a schematic view of an embodiment of a pressing system and a last assembly.

FIG. 5 illustrates a schematic view of components of a footwear pressing system 500, which may be used in conjunction with last assembly 100, according to an embodiment. Referring to FIG. 5, footwear pressing system 500 includes provisions for applying pressure over one or more regions of an article of footwear or portion of an article of footwear disposed on last assembly 100. In some embodiments, footwear pressing system 500 may be configured to provide pressure over last assembly 100.

In some embodiments, footwear pressing system 500 may include a base platform 502 and a pressing assembly 504. In some cases, base platform 502 may comprise a substantially flat rectangular surface. In other cases, base platform 502 could have any other geometry and could include provisions for receiving a last assembly, such as one or more recessed portions into which a portion of a last may be fit. Pressing assembly 504 may be configured to fit over base platform 502. In some embodiments, pressing assembly 504 comprises an outer frame member 510 and a flexible membrane 512 that is mounted within the outer frame member 510. As shown in FIG. 5, in some embodiments outer frame member 510 may include handles 514 that facilitate ease of handling.

In different embodiments, the materials used for flexible membrane 512 could vary. Examples of flexible materials that may be used include, but are not limited to: flexible textiles, natural rubber, synthetic rubber, silicone, elastomers, other elastomers such as silicone rubber, as well as other materials known in the art.

For purposes of clarity, only some provisions of footwear pressing system 500 are shown in the Figures. However, in other embodiments, additional provisions could be provided. Examples of additional provisions include, but are not limited to, provisions for supplying a vacuum between pressing assembly 504 and base platform 502, provisions for applying heat to objects in contact with flexible membrane 512, provisions for supplying power to components of footwear pressing system 500, control buttons, fasteners for clamping pressing assembly 504 and base platform 502 together as well as any other provisions. Examples of such provisions are disclosed in Hull, U.S. Pat. No. 8,162,022, filed Oct. 3, 2008, and titled "Method of Customizing an Article and Apparatus", the entirety of which is hereby incorporated by reference.

Figure 6:
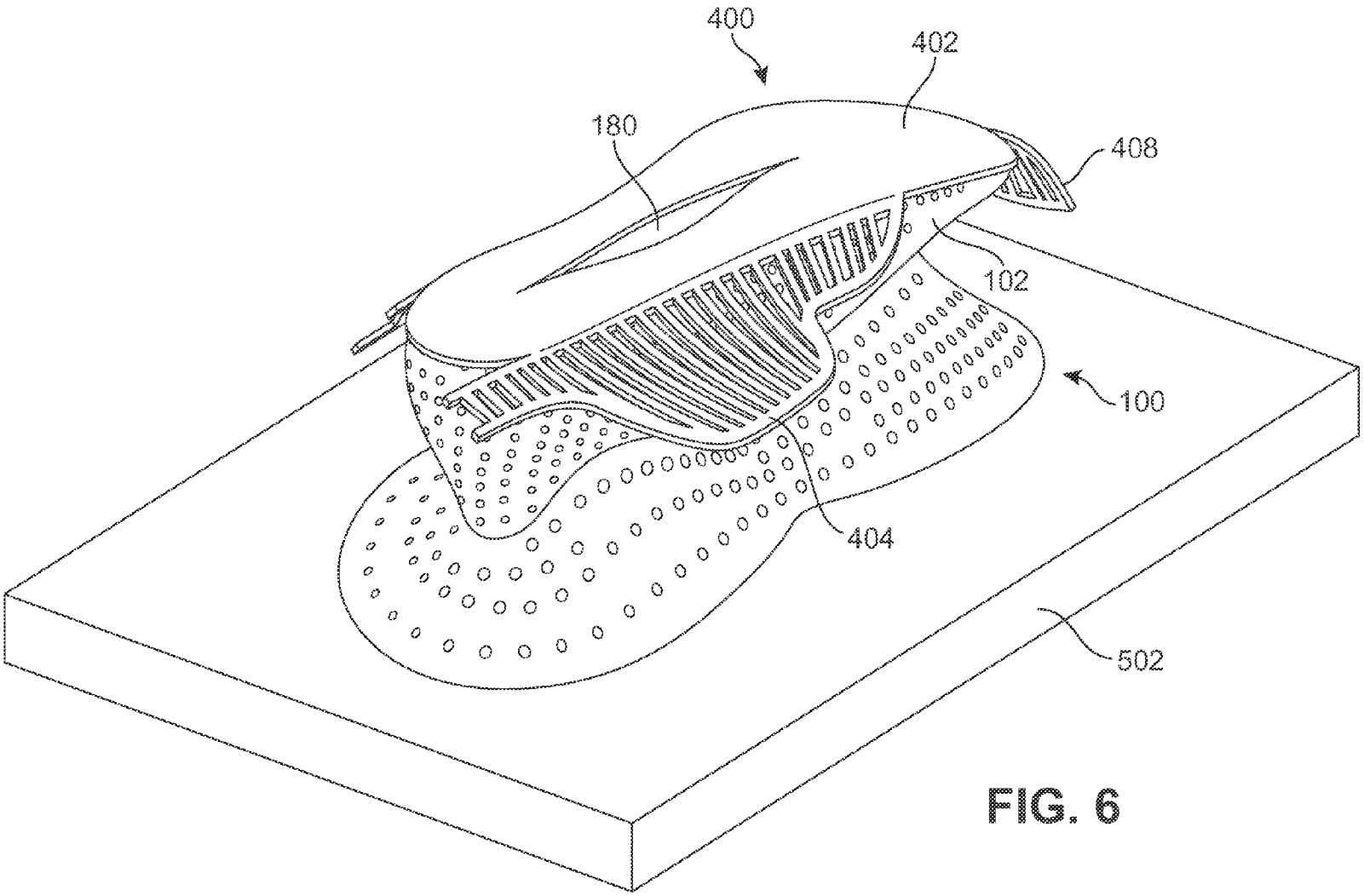
FIG. 6 is a schematic rear isometric view of an embodiment of a section of material placed onto a last assembly.

FIGS. 6 through 10 illustrate steps in a method of making an upper according to an embodiment using pressing system 500. As seen in FIG. 6, last assembly 100 may be placed on base platform 502 of pressing system 500. Referring first to FIG. 6, section of material 400 may be placed on last member 102 so that bottom portion 402 of section of material 400 is disposed against bottom surface 180 of last member 102. As seen in FIG. 6, the inverted configuration of last member 102 allows for section of material 400 to rest in place over last member 102 with little or no additional fastening provisions. In particular, this inverted configuration utilizes gravity as the primary means for holding section of material 400 against last member 102 before pressing assembly 504 is lowered.

Figure 7:
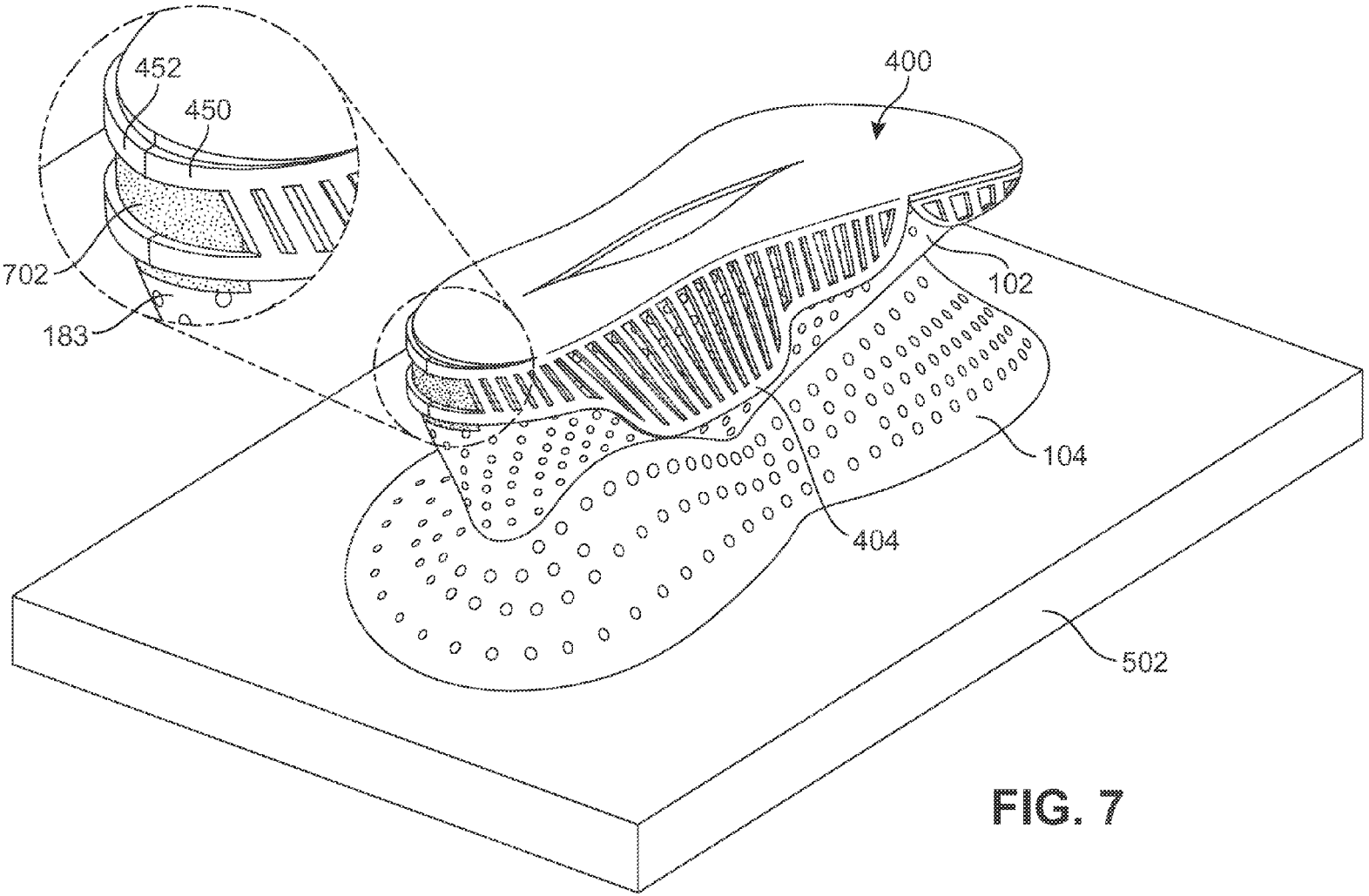
FIG. 7 is a schematic rear isometric view of an embodiment of a section of material placed onto a last assembly, in which some portions of the section of material are temporarily fixed in place on the last assembly.

Next, as seen in FIGS. 7 and 8, some portions of section of material 400 may be temporarily attached to, or otherwise associated with, various surfaces of last member 102. For example, in some cases, first rearwardly extending portion 450 and second reawardly extending portion 452 may be fastened to heel region 183 of last member 102. In some cases, this temporary fastening can be achieved using a temporary adhesive layer 702 that holds first rearwardly extending portion 450 and second rearwardly extending portion 452 in place adjacent to one another. In some cases, additional portions of first side portion 402 and second side portion 404 could be temporarily fastened or otherwise associated with various regions and/or surfaces of last member 102.

As seen in FIG. 8, in some cases, toe portion 408 may be temporarily attached or fastened to toe region 11 of last member 102. In some cases, this temporary fastening can be achieved by inserting first retractable pin 191, second retractable pin 192 and third retractable pin 193 through various slots 460 on toe portion 408. In other embodiments, toe portion 408 may be configured with specific holes or other provisions for receiving first retractable pin 191, second retractable pin 192 and third retractable pin 193, respectively. In still other embodiments, an adhesive or other fastening means could be used to temporarily fixe toe portion 408 in place on last member 102.

Figure 9:
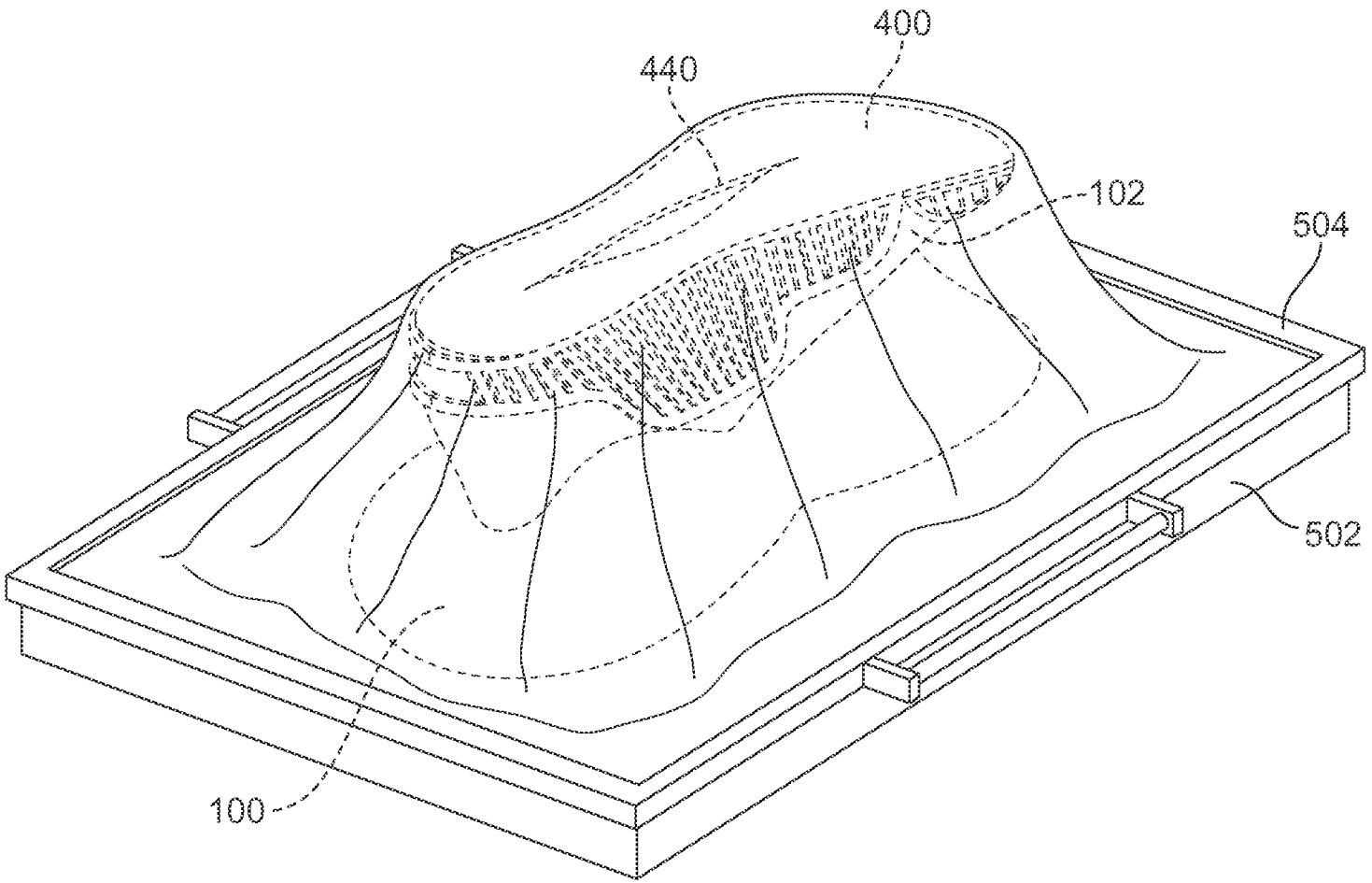
FIG. 9 is a schematic view of an embodiment of a pressing assembly placed over a last assembly.

Once section of material 400 has been placed onto last member 102, pressing assembly 504 may be placed over last assembly 100 and section of material 400, as seen in FIG. 9. In some cases, pressing assembly 504 may be secured to base platform 502 in a manner that provides a fluid seal between pressing assembly 504 and base platform 502. This sealed configuration may facilitate later steps of applying a vacuum within the region interior to pressing system 500.

Referring now to FIG. 10, a vacuum may be applied between flexible membrane 512 and base platform 502. As the pressure between flexible membrane 512 and base platform 502 decreases, the environment may apply a force that presses flexible membrane 512 against section of material 400. This has the effect of compressing section of material 400 between flexible membrane 512 and last member 102, which helps to form the desired three-dimensional contoured shape for the formed upper 1000 (see FIG. 11). In some cases, heat may also be applied simultaneously with pressure, for example, through heating elements disposed within flexible membrane 512. In other cases, heat can be applied via any other portions of pressing assembly 500 as well as from a separate heat source. With the application of pressure and heat to section of material 400, some portions that are disposed directly adjacent to one another may fuse or otherwise bond together. For example, in the current embodiment, first rearwardly extending portion 450 and second rearwardly extending portion 452 (see FIG. 7) may be fused at heel region 183, thereby forming an integral rearward portion for the formed upper 1000. In embodiments where multiple layers of material are placed onto last member 102, these multiple layers can be fused together during this process.

As seen in FIG. 10, plurality of vacuum holes 150 may help ensure that section of footwear 400 stays in place on last assembly 100. For purposes of clarity, FIG. 10 illustrates an enlarged cross section of one region where plurality of vacuum holes 150 are disposed on last member 102. However, it will be understood that this discussion may equally apply for other regions of last assembly 100 including vacuum holes.

In some embodiments, plurality of vacuum holes 150 may provide areas where flexible membrane 512 presents an increased inward force to hold section of material 400 in place on last assembly 102. For example, first set of vacuum holes 152 provide a path for air trapped between the various layers to flow to a region of lower air pressure. This causes flexible membrane 512 (which is under the force of the ambient air) to push inwardly, compressing section of material 400 against last member 102 in the vicinity of first set of vacuum holes 152. This configuration creates regions on either side of last member 102 where the pressure of flexible membrane 512 is strong enough to hold section of material 400 in place. This helps to ensure that the portions of section of material 400 stay in place on last member 102 while the pressure (and possibly heat) applied by pressing assembly 504 facilitates contouring of portions and fusing between various portions of material.

In some embodiments, second set of vacuum holes 156 may provide a path for air trapped between flexible membrane 512 and base member 104 to travel to a region of lower air pressure. This causes flexible membrane 512 (which is under the force of the ambient air) to wrap tightly over base member 104. Moreover, the geometry of base member 104 helps facilitate a smooth transition for flexible membrane 512 between last assembly 100 and base platform 502. In particular, the contoured shape of base member 104 allows flexible membrane 512 to gently curve down from last member 102 to base member 104. This arrangement may help avoid abrupt folds, sharp bends or edges in flexible membrane 512 that may impede the strength of the applied vacuum in the vicinity of last assembly 100 or which may possibly damage flexible membrane 512.

As seen most clearly in FIG. 10, the exemplary embodiments provide a configuration in which a large percentage of the pressure applied by flexible membrane 512 is applied along bottom surface 180 of last member 102, including the peripheral regions of first side surface 182 and second side surface 184 disposed directly adjacent to bottom surface 180. Therefore, the majority of the pressure applied for shaping and/or bonding portions of section of material 400 may be applied at bottom portion 402, as well as first peripheral side portion 480 and second peripheral side portion 482, which extend between bottom portion 402 and first side portion 404 and second side portion 406, respectively. Moreover, with this configuration the downward pressure of pressing assembly 504 may further tighten section of material 400 against last member 102, which helps to maintain the desired alignment during the forming process In other embodiments, other methods of applying pressure to last assembly 100 may be used. For example, in one alternative embodiment, pressing system 500 (or part of pressing system 500) may be placed inside an external fluid chamber that can be pressurized. As the pressure inside the chamber is increased, the external pressure applied by the chamber fluid to the flexible membrane 512 may increase, which may increase the pressure of flexible membrane 512 section of material 400 against last member 102. As one possible example, pressing system 500 could be disposed within a larger pressurized fluid chamber. In this example, last assembly 100 with a section of material is placed between pressing assembly 504 and base platform 502. By increasing the pressure of the external fluid chamber, flexible membrane 512 may further press against last member 100 and the section of material. In some cases, this may be done in combination with a vacuum pressure applied within pressing system 500. In other cases, this may be done without the use of a vacuum pressure within pressing system 500. Embodiments including an external pressurized chamber could utilize any fluids including gases (such as air) and liquids. To achieve external pressure on a flexible membrane, embodiments could use any of the components or systems disclosed in Fisher et al., now U.S. Pat. No. 9.259, 877, U.S. Patent Application Publication No. 2014/0239556, U.S. Patent application Ser. No. 13/773,744, filed Feb. 22, 2013 and titled "System and Method for Applying Heat and Pressure to Three-Dimensional Articles", the entirety of this document being incorporated by reference herein.

Figure 11:
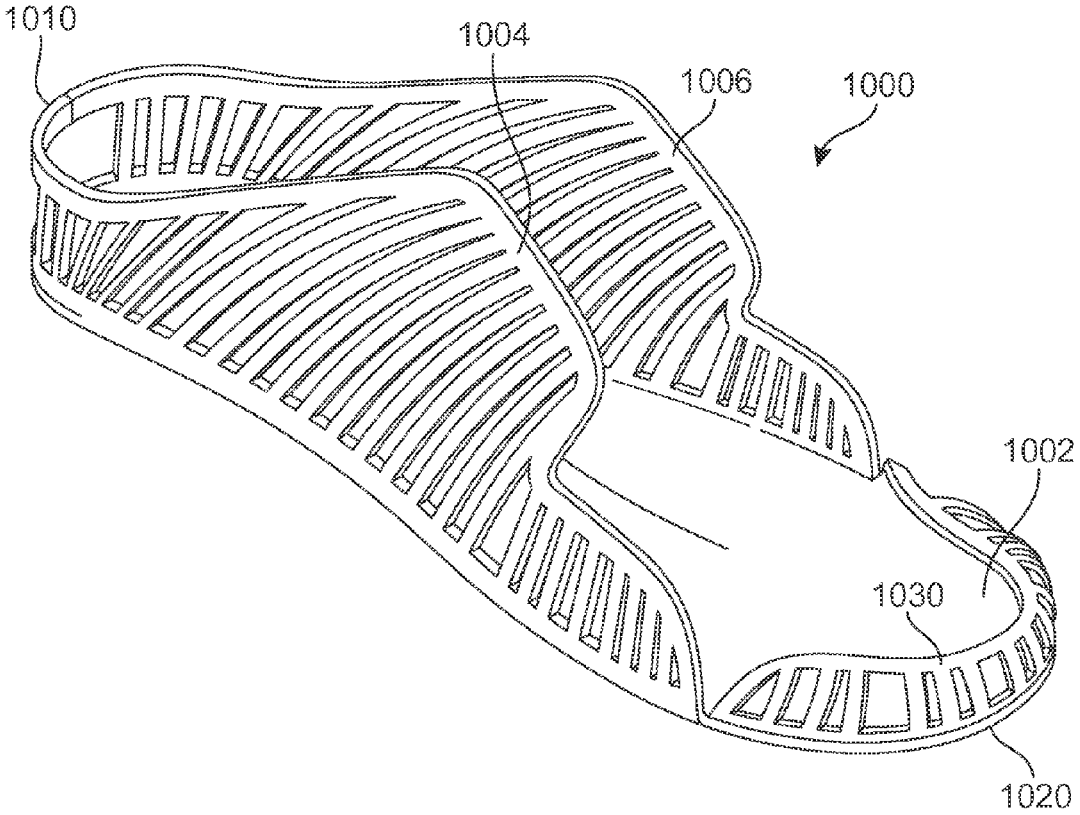
FIG. 11 is a schematic isometric view of an embodiment of an upper formed using the last assembly and pressing assembly of FIG. 9.

As also seen in FIG. 10, as flexible membrane 512 applies pressure to, and/or heats, bottom portion 402, central slit 440 may be permanently closed and sealed so that the bottom portion of the formed upper is continuous without any gaps (see FIG. 11). In other embodiments, however, central slit 440 could remain partially open or separated following the forming process to further facilitate assembly of other materials with the formed upper.

FIG. 11 illustrates an embodiment of an upper 1000 that has been formed from the process described above. In particular, upper 1000 may be configured with a bottom portion 1002, a first side portion 1004 and a second side portion 1006 that have been made from shaping the bottom portion 402, first side portion 404 and second side portion 406, respectively, of section of material 400. In this embodiment, first side portion 1004 and second side portion 1006 are substantially continuous with bottom portion 1002. In addition, in this embodiment, first rearwardly extending portion 450 and second rearwardly extending portion 452 have been joined and shaped to form a rearward portion 1010 of upper 1000. Likewise, toe portion 408 of section of material 400 has been shaped and bonded along a front edge 1020 of bottom portion 1002 to form toe covering portion 1030 of upper 1000.

Figure 12:
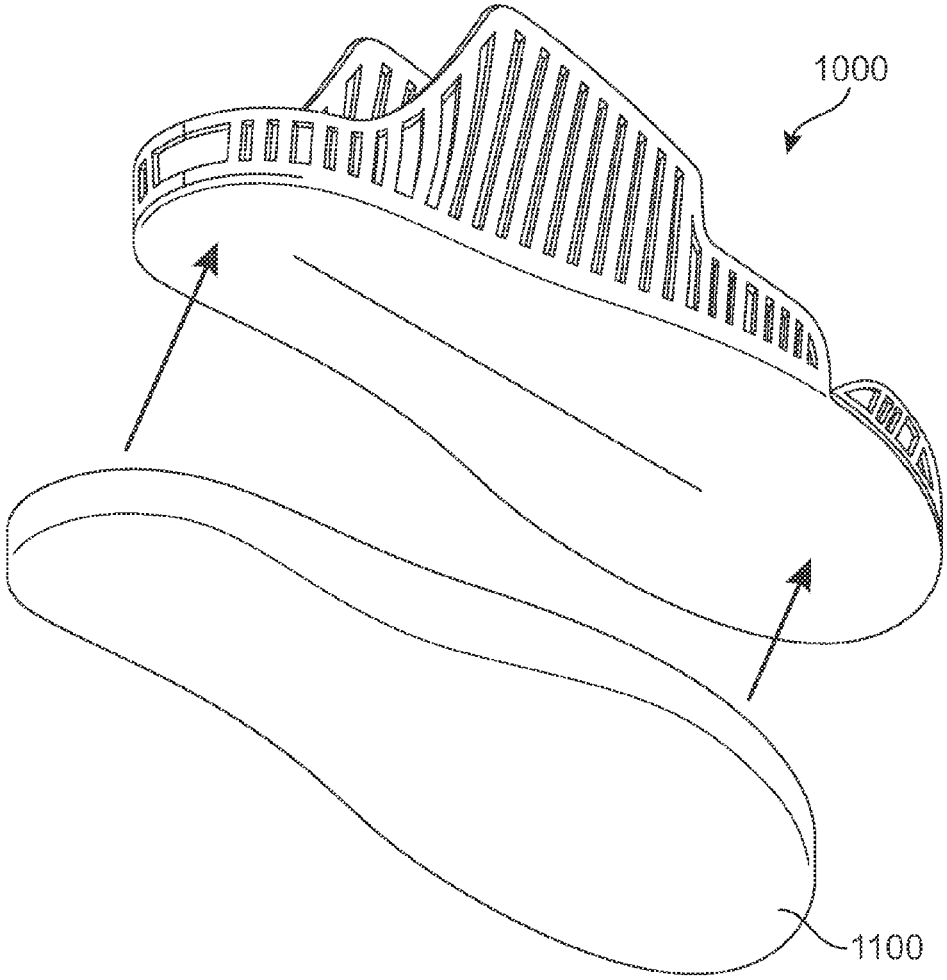
FIG. 12 is a schematic bottom isometric view of an embodiment of a sole structure being associated with a bottom portion of the upper of FIG. 11.
Figure 13:
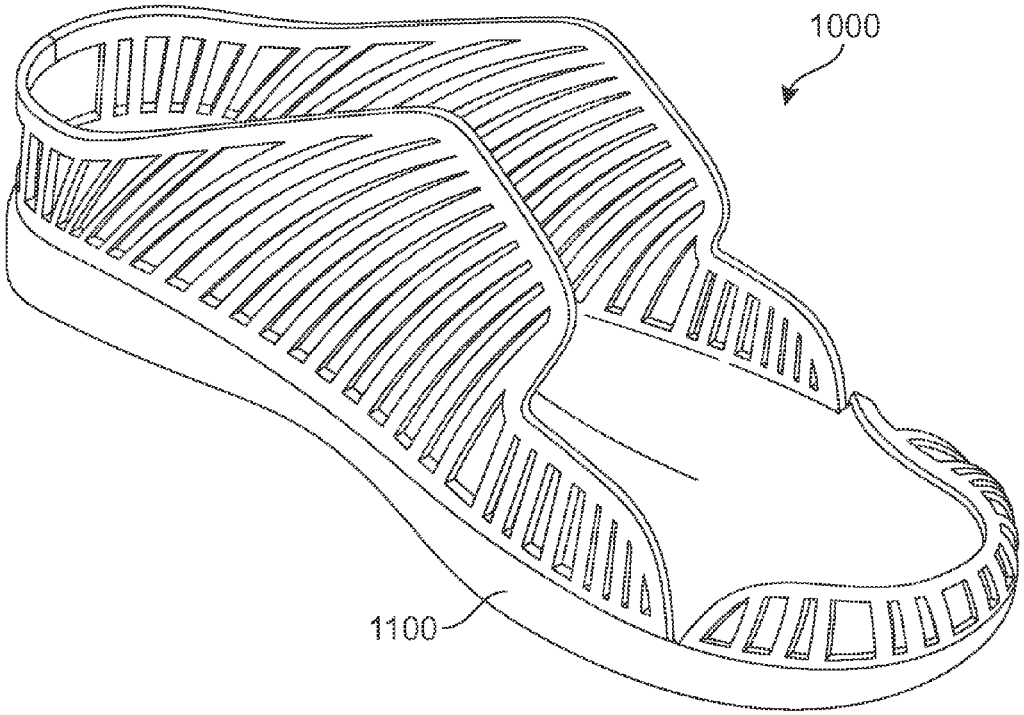
FIG. 13 is a schematic isometric view of an embodiment of an upper assembled with a sole structure.

In contrast to some alternative embodiments of an upper, upper 1000 may be configured with bottom portion 1002 that may be bonded directly to a sole structure 1100, as shown in FIGS. 12 and 13. This allows for a method of making an article of footwear without a traditional strobel, which may improve manufacturing efficiency.

Figure 14:
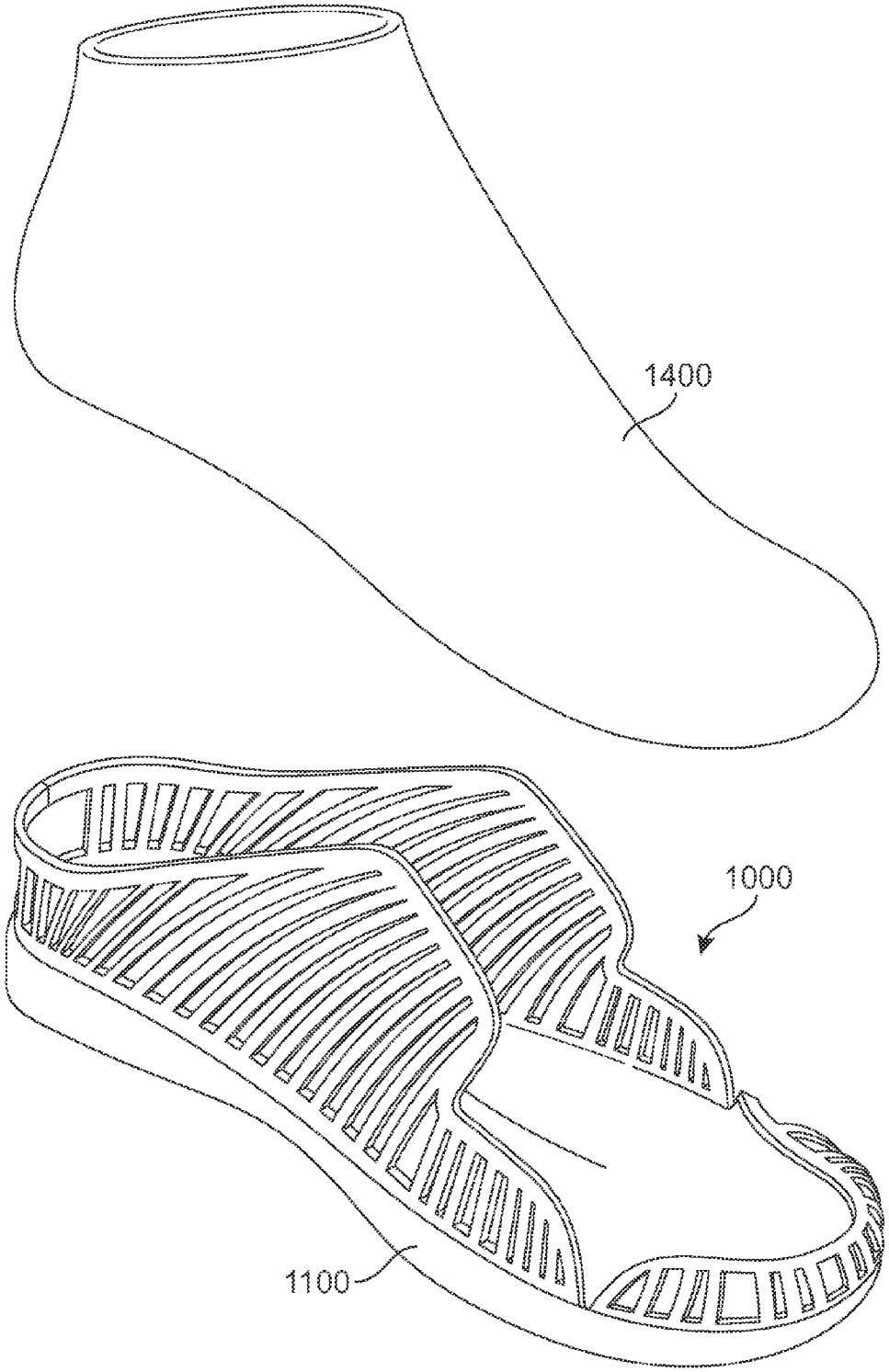
FIG. 14 is a schematic isometric view of an embodiment of an inner member being associated with the upper and sole structure of FIG. 13.
Figure 15:
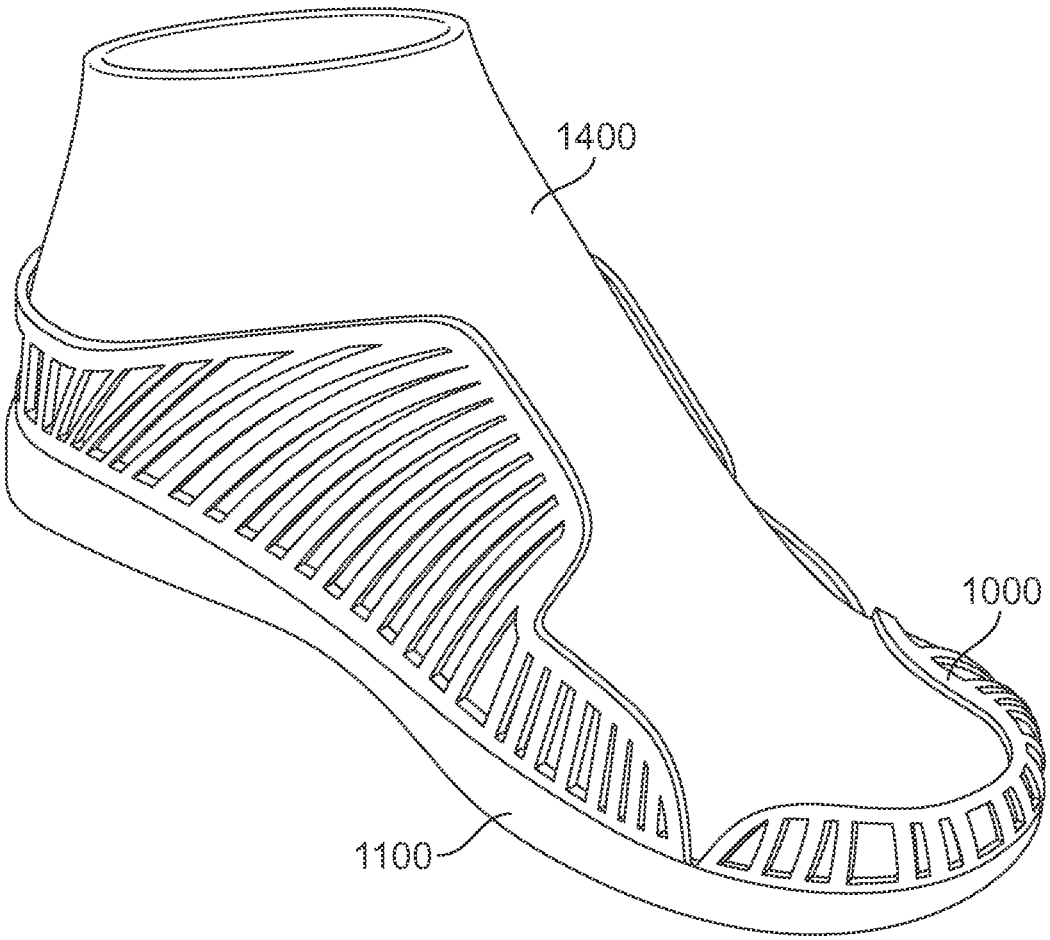
FIG. 15 is a schematic isometric view of an embodiment of an article of footwear with an inner member, an upper and a sole structure.

Some embodiments could include provisions for further associating upper 1000 and sole structure 1100 with additional structures, such as, for example, a bootie or other inner liner. Booties, inner layers or liners may be generally referred to as "inner members" throughout this detailed description and in the claims. Referring to FIGS. 14 and 15, in some embodiments, once upper 1000 has been formed, inner member 1400 (in the form here of a bootie) may be inserted into upper 1000 in order to provide more coverage for a foot. In some cases, an inner member could be associated with upper 1000 prior to the attachment of upper 1000 and sole structure 1100, while in other cases, an inner member (such as a bootie, liner or other inner layer) could be associated with upper 1000 after upper 1000 has been attached to sole structure 1100. Moreover, inner member 1400 could be permanently attached to upper 1000, using adhesives for example, or could be removably attached to upper 1000.

Figure 16:
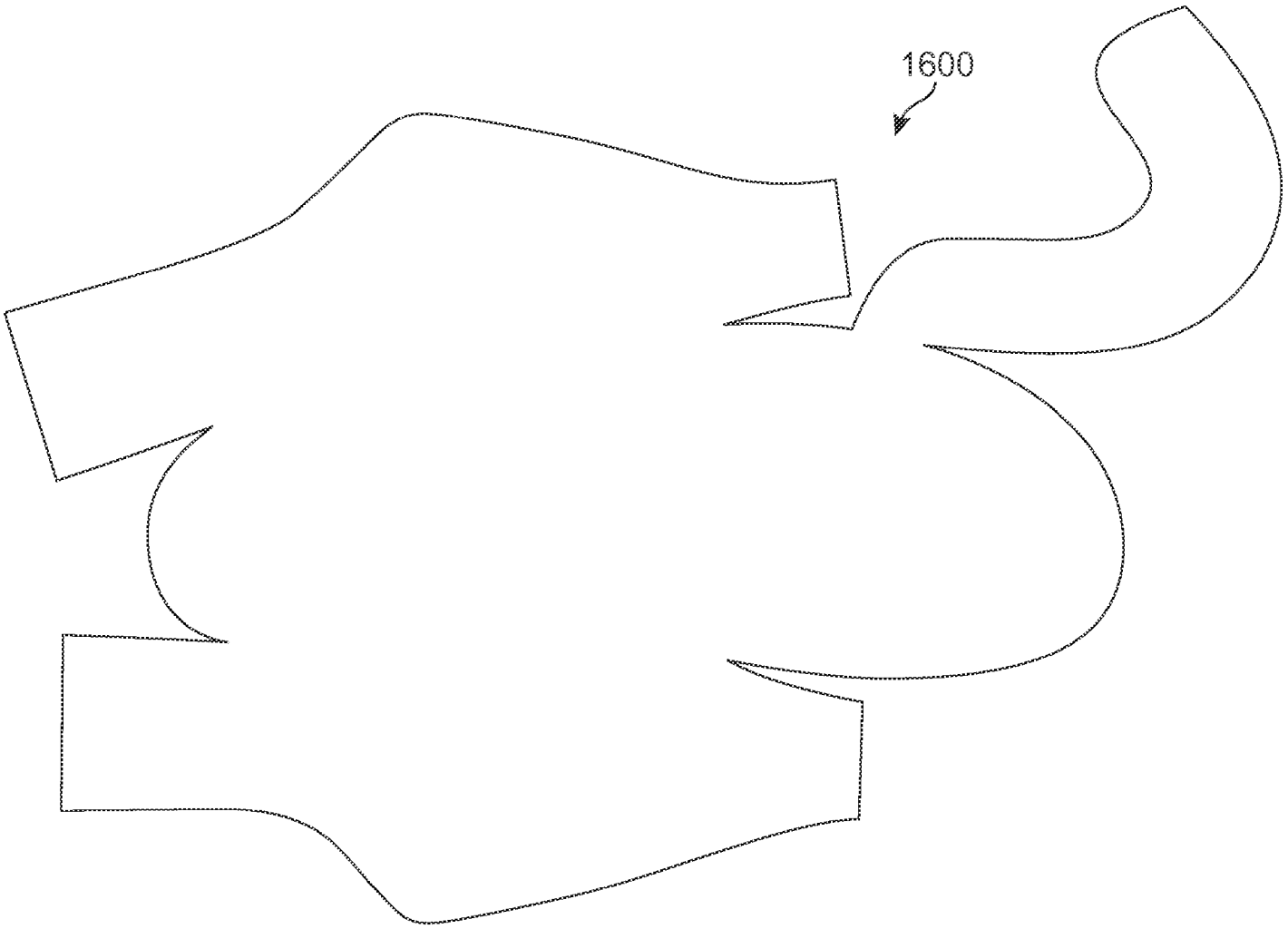
FIG. 16 is a schematic plan view of another embodiment of a section of material used for forming an upper.
Figure 17:
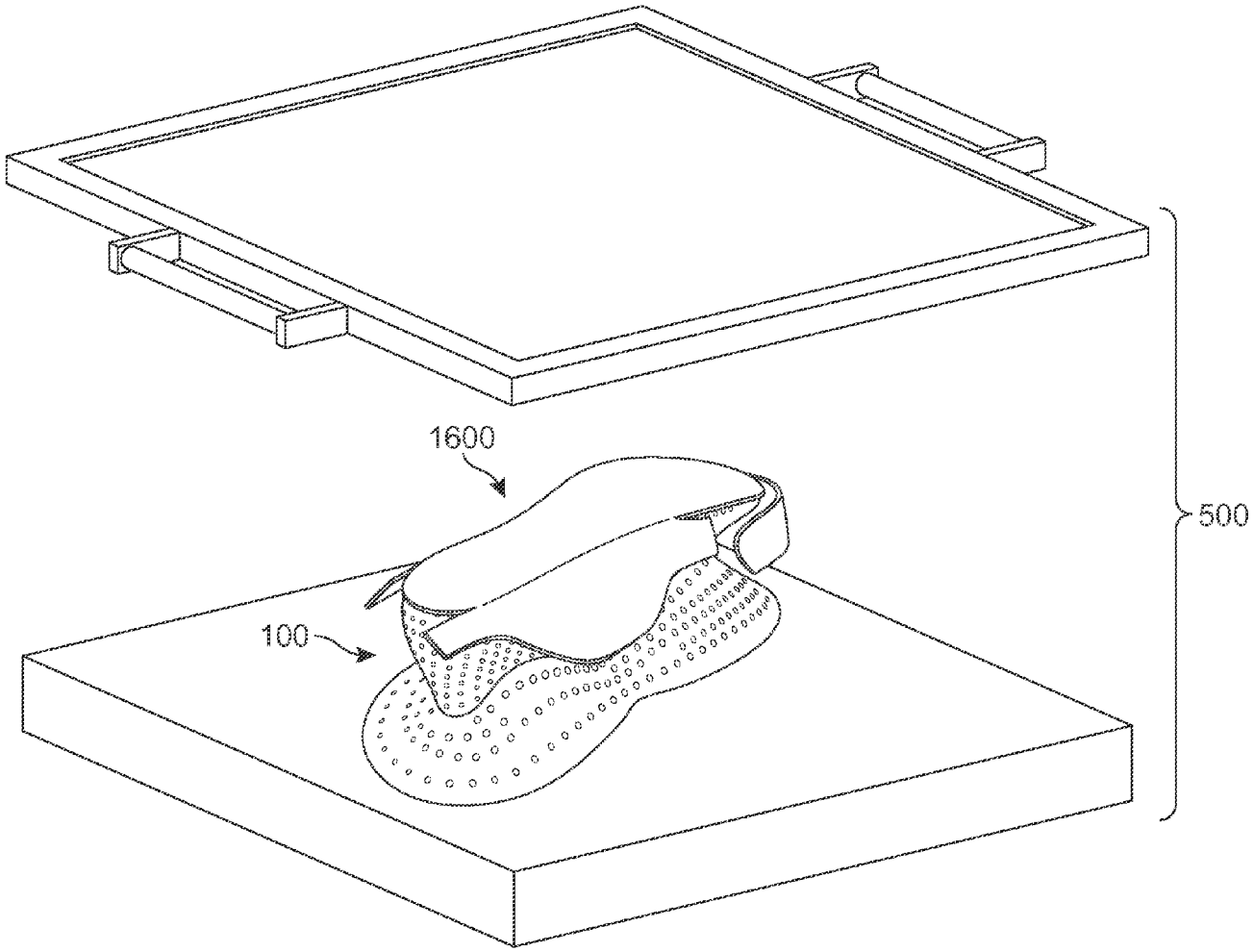
FIG. 17 is a schematic view of an embodiment of the section of material of FIG. 16 associated with a last assembly and a pressing system.
Figure 18:
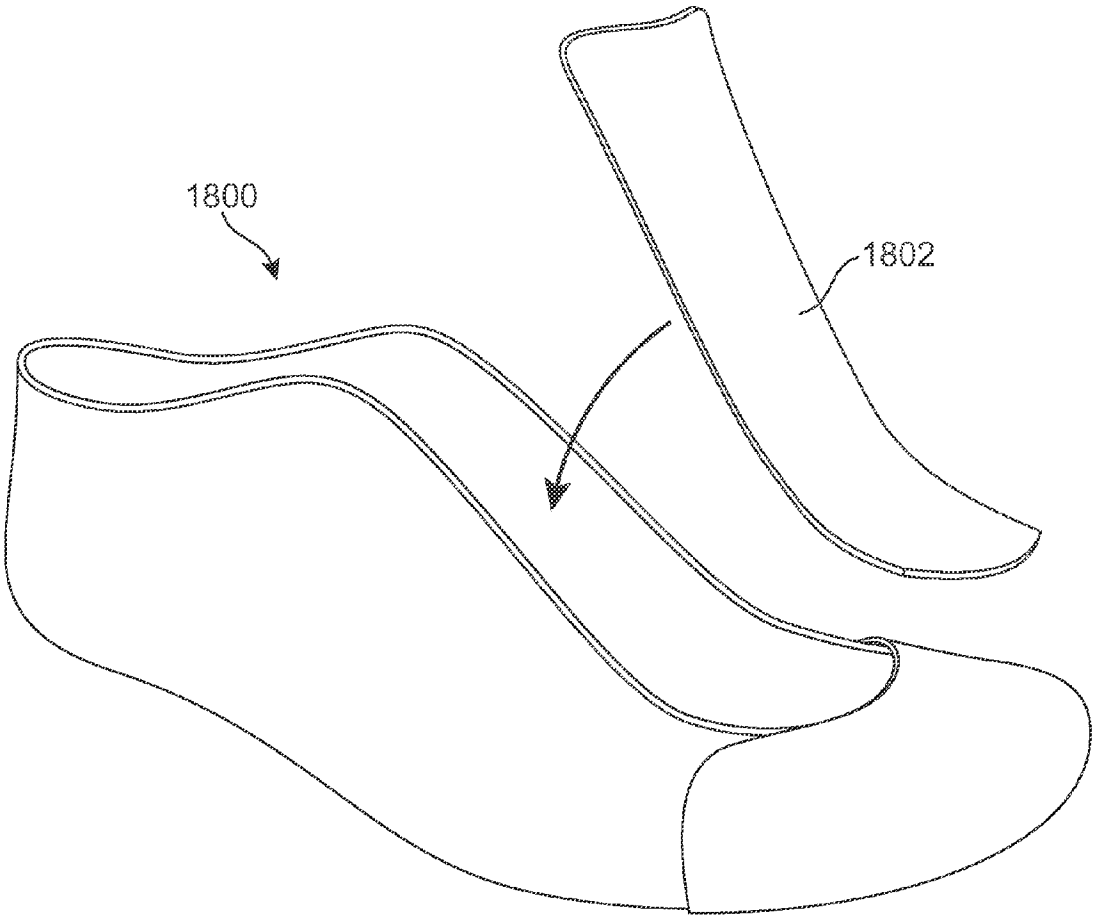
FIG. 18 is a schematic isometric view of an embodiment of an upper formed using the last assembly and pressing system of FIG. 17.
Figure 19:
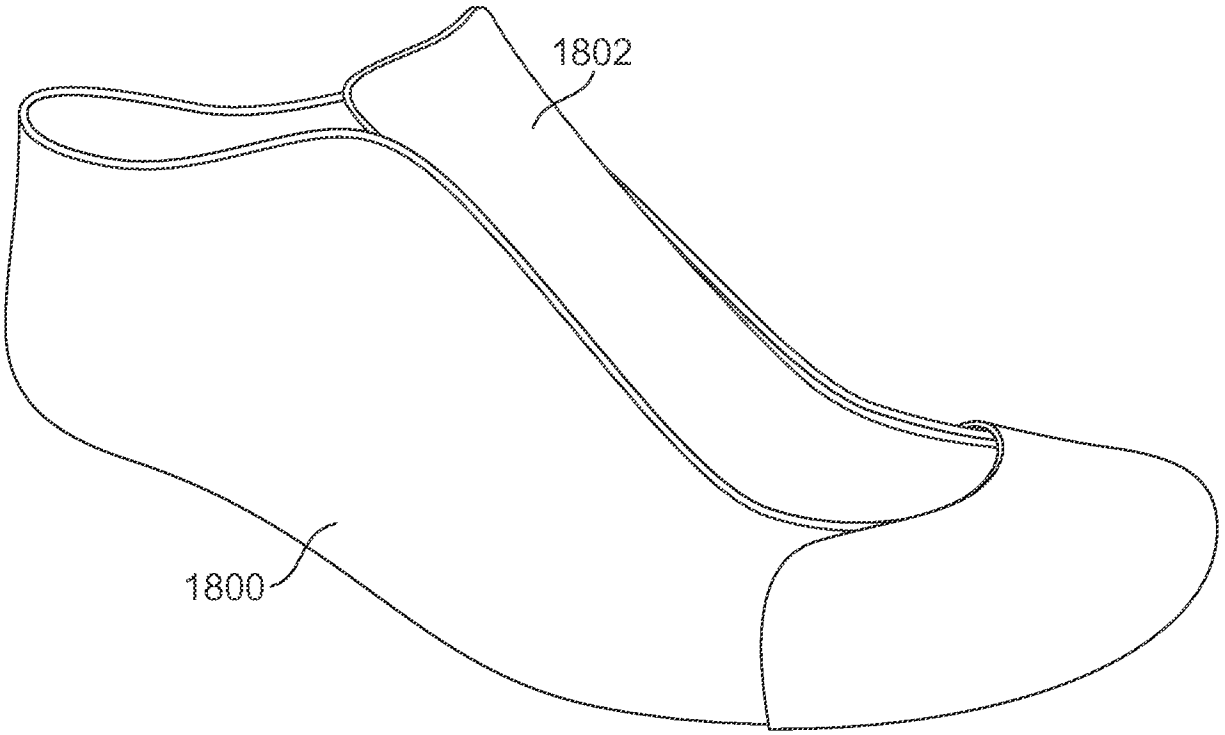
FIG. 19 is a schematic isometric view of the upper of FIG. 18 with a tongue portion stitched to the upper.

FIGS. 16 through 19 illustrate another embodiment of a method of forming an upper, where an alternative geometry is used for a section of material. Referring first to FIG. 16, section of material 1600 has a geometry suitable to forming a moccasin type upper. In particular, section of material 1600 may be placed over last assembly 100 and pressed and/or heated using pressing system 500 as described earlier and indicated schematically in FIG. 17. In some embodiments, the resulting upper 1800 has the moccasin-like configuration shown in FIG. 18. In some embodiments, upon stitching or otherwise associating a tongue 1802 with upper 1800, a moccasin-like article can be made, as seen in FIG. 19. At this point, upper 1800 may or may not be further assembled with a sole structure.

As seen in FIG. 19, upper 1800 may provide substantially more coverage for a foot than upper 1000, which is shown in FIG. 11 and previously described above. Unlike upper 1000, which has a substantially open design or configuration, upper 1800 has a more traditional closed design that is open only at the ankle and throat. Thus, upper 1800 may provide consistent protection for the foot over various portions, including the forefoot, midfoot and heel portions, without the need for additional internal or external components. When assembled with a sole structure, upper 1800 may be used for making traditional types of athletic shoes including, for example, running shoes, soccer cleats, football cleats, basketball shoes as well as other kinds of shoes. In particular, upper 1800 is seen to have the outward appearance of an upper manufactured by more traditional methods, though upper 1800 includes a continuous bottom layer absent from the uppers of many current athletic footwear designs.

In some embodiments, an upper can be formed by fusing, bonding or otherwise joining one or more sections of material to an inner member, such as a bootie or inner liner. FIGS. 20 through 25 illustrate another embodiment in which an inner member is associated with a last assembly and sections of material are fused directly to the inner member using a pressing assembly.

Figure 20:
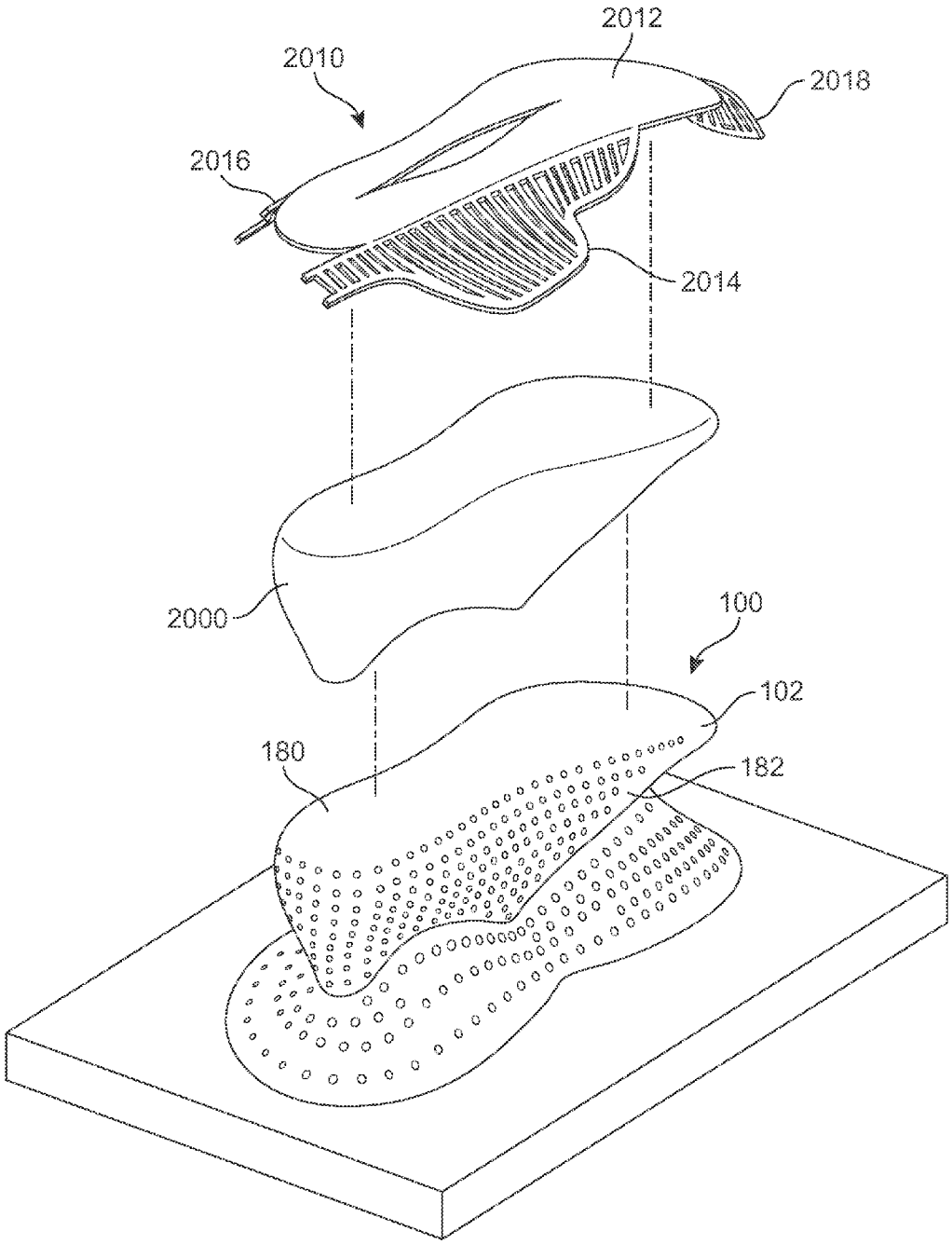
FIG. 20 is a schematic isometric view of an embodiment of a section of material and an inner member configured for placement on a last assembly.

Referring first to FIG. 20, an inner member 2000 and corresponding section of material 2010 may be associated with last assembly 100. In this embodiment, section of material 2010 may be substantially similar to section of material 400 of an earlier embodiment, including, for example, a variety of different portions such as bottom portion 2012, a first side portion 2014 and a second side portion 2016. In some cases, section of material 2010 may also include a distinct toe portion 2018. The various portions may be configured to form corresponding portions of an upper. In some embodiments, for example, bottom portion 2012, first side portion 2014, second side portion 2016 and toe portion 2018 may be associated with the bottom portion, first side portion, second side portion and toe portion, respectively, of a three-dimensional formed upper, as discussed in further detail below. Likewise, inner member 2000 may be substantially similar to inner member 1400 of the previous embodiments.

Figure 21:
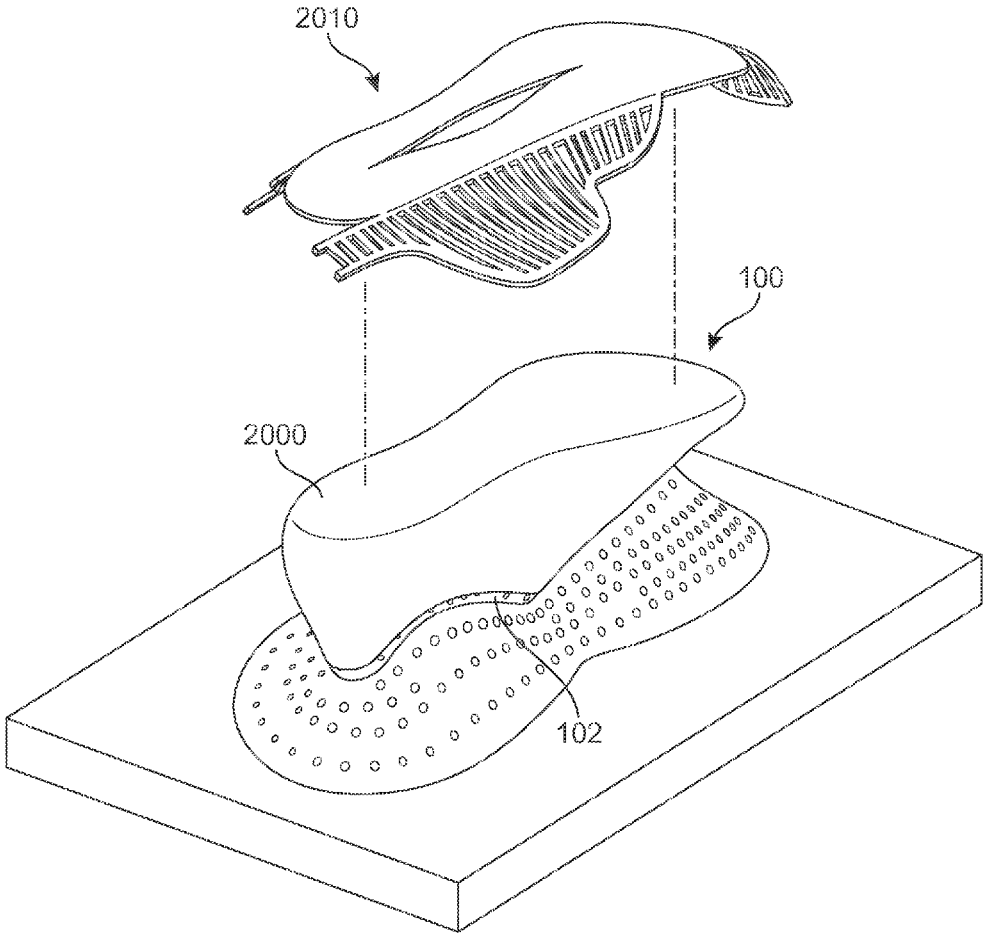
FIG. 21 is a schematic isometric view of the last assembly of FIG. 20 with the inner member placed onto the last assembly.

Referring next to FIG. 21, inner member 2000 may be placed onto last member 102 of last assembly 100. In some embodiments, inner member 2000 is substantially flexible and/or elastic enough so that inner member 2000 generally conforms to the geometry of last member 102. In other embodiments, however, provisions could be included to ensure that inner member 2000 generally conforms to the geometry of last member 102, for example, using vacuum pressure generated within last member 102.

Figure 22:
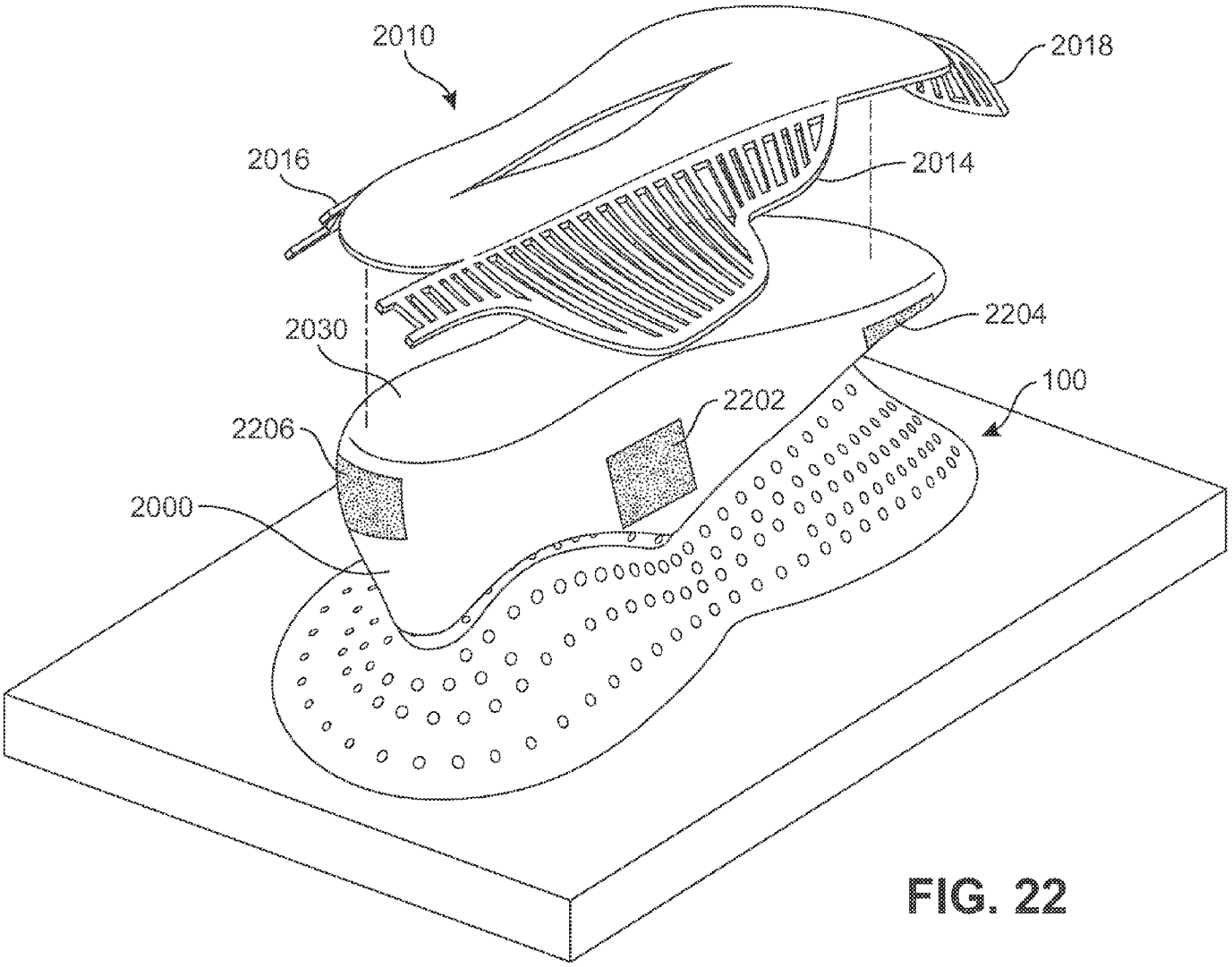
FIG. 22 is a schematic isometric view of an embodiment of adhesive layers being placed onto an inner member that is on a last assembly.
Figure 23:
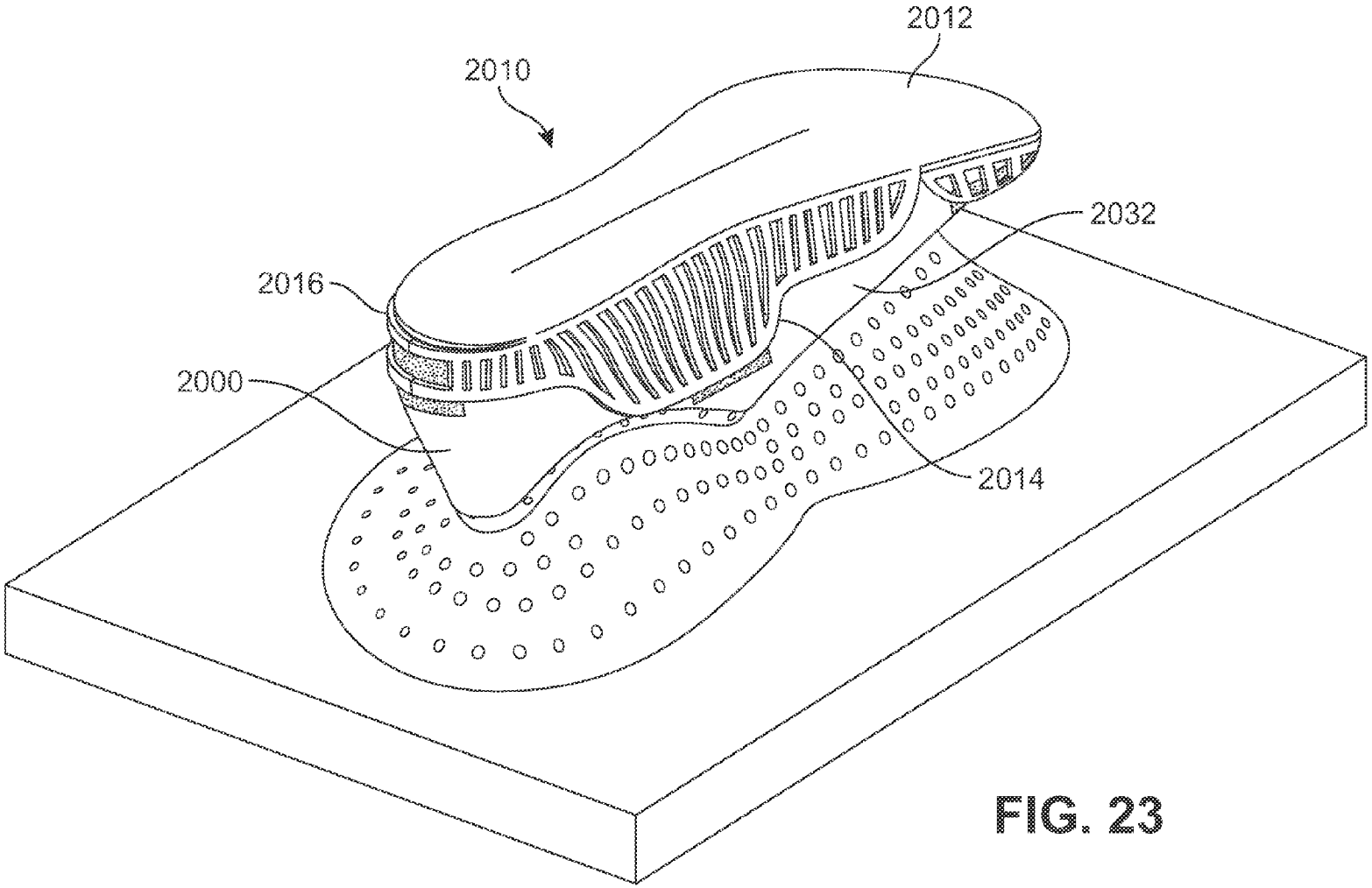
FIG. 23 is a schematic isometric view of an embodiment of a section of material placed onto an inner member and temporarily secured using adhesive layers.

In order to temporarily fix portions of section of material 2010 in place on inner member 2000 prior to the application of heat and pressure, some embodiments may include adhesive layers. For example, as seen in FIG. 22, adhesive layer 2202 and adhesive layer 2204 may be used to temporarily hold first side portion 2014 and toe portion 2018, respectively, against inner member 2000 prior to applying a pressing assembly over last assembly 100. Additionally, adhesive layer 2206 may be used to hold the rearward ends of first side portion 2014 and second side portion 2016 in place along the heel region of inner member 2000. In some cases, another adhesive layer (not shown) may be used to hold second side portion 2016 in place on inner member 2000. Moreover, additional adhesive layers and/or other provisions for holding portions of a section of material in place on inner member 2000 can be used. Examples include one or more retractable pins as well as other fasteners or provisions. As seen in FIG. 23, once various adhesive layers have been positioned on inner member 2000, section of material 2010 may be placed on inner member 2000. In particular, to facilitate alignment during the bonding process, portions of section of material 2010 may be held against inner member 2000 using one or more adhesive layers.

In this arrangement, bottom portion 2012 of section of material 2010 may confront, and substantially cover, a bottom portion 2030 (see FIG. 22) of inner member 2000. Furthermore, bottom portion 2012 of section of material 2010 may be disposed adjacent to bottom surface 180 (see FIG. 20) of last member 102. In particular, bottom portion 2030 of inner member 2000 is disposed between bottom portion 2012 of section of material 2010 and bottom surface 180 of last member 102. Bottom portion 2012 may be configured to be joined with bottom portion 2030 of inner member 2000. Likewise, first side portion 2014 of section of material 2010 may be disposed adjacent to, and configured to be joined with, first side 2032 of inner member 2000. First side portion 2014 of section of material 2010 may be disposed adjacent to first side surface 182 of last member 102. In particular, first side 2032 of inner member 2000 is disposed between first side portion 2014 and first side surface 182. Furthermore, second side portion 2016 of section of material 2010 may be disposed adjacent to, and configured to be joined with, second side 2034 (see FIG. 24) of inner member 2000. Second side portion 2016 of section of material 2010 may be disposed adjacent to second side surface 184 of last member 102 (see FIG. 24). In particular, second side 2034 of inner member 2000 is disposed between second side portion 2016 and second side surface 184. With this arrangement, section of material 2010 may be configured to join with, and conform to the shape of, inner member 2000.

Figure 24:
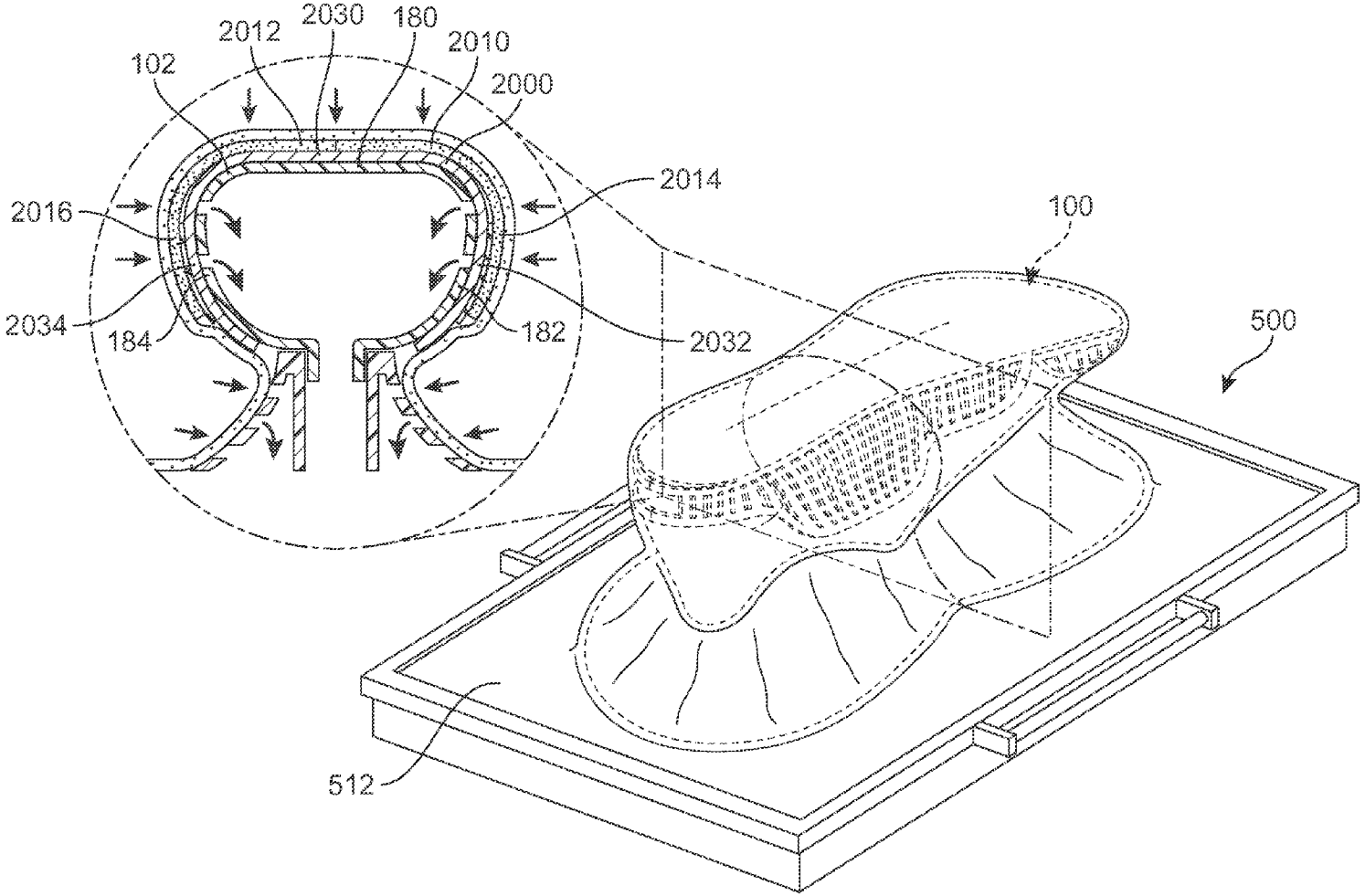
FIG. 24 is a schematic isometric view of an embodiment of a pressing assembly placed over an inner member and section of material, which are disposed on a last assembly.

Referring now to FIG. 24, pressing assembly 500 may be placed over last assembly 100, which includes inner member 2000 and section of material 2010 aligned over inner member 2000. As the pressure between flexible membrane 512 and base platform 502 decreases, the environment may apply a force that presses flexible membrane 512 against section of material 2010. This has the effect of compressing section of material 2010 and inner member 2000 between flexible membrane 512 and last member 102, which helps to bond section of material 2010 to inner member 2000. In some cases, heat may also be applied simultaneously with pressure, for example, through heating elements disposed within flexible membrane 512. In other cases, heat can be applied via any other portions of pressing assembly 500 as well as from a separate heat source. Moreover, with the application of pressure and heat to section of material 2010, some portions that are disposed directly adjacent to one another may fuse or otherwise bond together.

Figure 25:
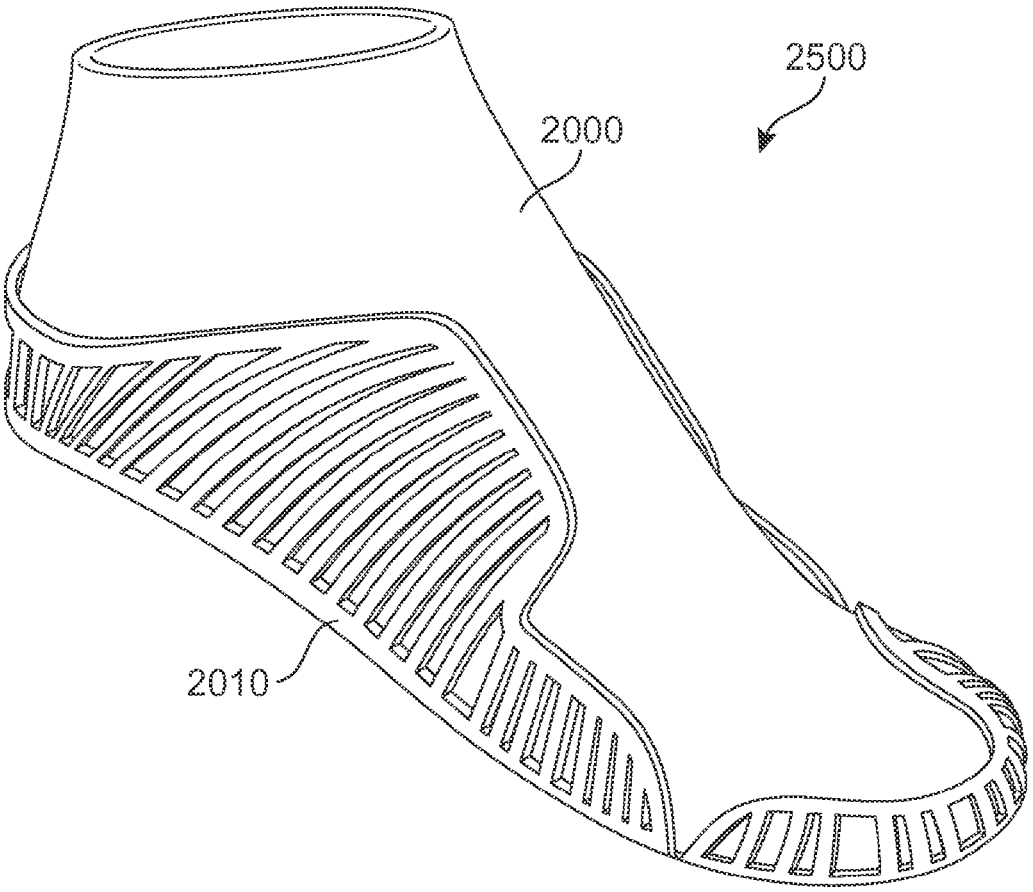
FIG. 25 is a schematic isometric view of an embodiment of an upper including an inner member and a section of material attached to the inner member to form portions of the upper.

The resulting upper 2500, shown in FIG. 25, is comprised of inner member 2000 with section of material 2010 bonded directly to inner member 2000. Thus, the process described above fuses section of material 2010 directly to inner member 2000 such that section of material 2010 is shaped to the contours of last member 102. As with the previous embodiments, the formed upper 2500 includes a first side portion and a second side portion that are substantially continuous with a bottom portion of upper 2500. This yields an upper 2500 that is closed on the bottom and therefore encloses a foot from all sides.

While various embodiments of the embodiments have been described, the description is intended to be exemplary, rather than limiting and it will be apparent to those of ordinary skill in the art that many more embodiments and implementations are possible that are within the scope of the embodiments. Accordingly, the embodiments are not to be restricted except in light of the attached claims and their equivalents. Also, various modifications and changes may be made within the scope of the attached claims.

What is claimed is:

1. A last assembly for use with making an upper for an article of footwear, the last assembly comprising: a last member having the approximate shape of a foot, wherein the last member further includes a bottom surface corresponding to a foot sole; wherein the last member includes a plurality of vacuum holes positioned on an outer surface of the last member along a lateral side of the last member and along a medial side of the last member, and further wherein the plurality of vacuum holes are in fluid communication with a vacuum pump; a base member configured to receive a portion of the last member and hold the last member in a substantially fixed position; wherein the base member having an outer peripheral edge and a receiving slot; wherein a length of the outer peripheral edge is greater than a length of the bottom surface of the last member and a width of the outer peripheral edge is greater than a width of the bottom surface of the last member; wherein the last member is mounted to the base member such that the bottom surface of the last member is oriented away from the base member; wherein the last member includes an interior hollow cavity that is in fluid communication with the plurality of vacuum holes on the outer surface of the last member; wherein the interior hollow cavity is in fluid communication with a central hollow cavity of the base member thereby allowing the plurality of vacuum holes on the last member to be placed in fluid communication with a vacuum pump applied to the base member; and wherein the base member includes a plurality of vacuum holes on an outer surface of the base member that are in fluid communication with the central hollow cavity of the base member.

2. The last assembly according to claim 1, wherein a width of the last member increases from the top portion to the bottom surface.

3. The last assembly according to claim 1, wherein the base member also includes a plurality of vacuum holes that extend substantially throughout the entirety of an outer surface of the base member.

4. The last assembly according to claim 1, wherein the last member includes at least one retaining feature and wherein the at least one retaining feature is configured to insert into a portion of material used in making an upper.

5. The last assembly according to claim 4, wherein the at least one retaining feature is a retractable pin.

6. The last assembly according to claim 1, wherein the receiving slot of the base member is configured to engage with the top portion of the last member thereby mounting the last member to the base member.

7. The last assembly according to claim 1, wherein the width of the last member is approximately widest at the outer peripheral edge of the base member.

8. The last assembly according to claim 1, wherein the last member may be configured to form an upper, and wherein the upper includes a bottom portion that extends continuously between two side portions.

9. A last assembly for use with making an upper for an article of footwear, the last assembly comprising: a last member having a forefoot portion, a heel portion opposite the forefoot portion, a midfoot portion disposed between the forefoot portion and the heel portion, and a top portion; wherein the last member includes a plurality of vacuum holes positioned on an outer surface of the last member along the forefoot portion, the midfoot portion and the heel portion of the last member, and further wherein the plurality of vacuum holes are in fluid communication with a vacuum pump; wherein the last member further includes an upper opening portion extending along the top portion of the last member from the heel portion, through the midfoot portion and partially into the forefoot portion; wherein the last member further includes a bottom surface corresponding to a foot sole; a base member having a receiving slot configured to receive the top portion of the last member and engage the last member in a substantially fixed position; wherein the last member is mounted to the base member such that the bottom surface of the last member is oriented away from the base member, the base member having a flange geometry that narrows inwardly from an outer peripheral edge to the receiving slot; and wherein the base member includes a plurality of vacuum holes on an outer surface of the base member that are in fluid communication with a central hollow cavity of the base member.

10. The last assembly according to claim 9, wherein the upper opening portion provides access to an interior hollow cavity of the last member.

11. The last assembly of claim 10, wherein the interior hollow cavity is in fluid communication with the central hollow cavity of the base member thereby allowing the plurality of vacuum holes on the last member to be placed in fluid communication with the vacuum pump.

* * * * *